US005385440A

United States Patent [19]

Raben

[11] Patent Number: 5,385,440

[45] Date of Patent: Jan. 31, 1995

[54] LIFT TRUCK ACCESSORIES FOR STACKING AND MOVING STACKS OF TIRES

[76] Inventor: Thomas M. Raben, 12548 Apache Pass Ave., Evansville, Ind. 47720

[21] Appl. No.: 38,144

[22] Filed: Mar. 26, 1993

Related U.S. Application Data

[63] Continuation-in-part of Ser. No. 917,779, Jun. 21, 1992, abandoned.

[51] Int. Cl.[6] ..... B66F 9/12

[52] U.S. Cl. ..... 414/608; 414/607; 414/623

[58] Field of Search ..... 414/27, 429, 445–446, 414/457, 607–608, 619, 622–623, 639, 641–643, 645, 785

[56] References Cited

U.S. PATENT DOCUMENTS

| | | | |
|---|---|---|---|
| 1,506,136 | 8/1924 | Remde | 414/642 X |
| 2,714,463 | 8/1955 | Fraser | 414/607 |
| 2,772,918 | 12/1956 | Klinger | 414/607 |
| 2,929,523 | 3/1960 | Cushman | 414/608 X |
| 2,959,313 | 11/1960 | Bettencourt et al. | 414/785 |
| 2,981,429 | 4/1961 | Williamson | 414/622 |
| 3,084,820 | 4/1963 | Malo | 414/445 |
| 3,118,555 | 1/1964 | Bent | 414/607 |
| 3,409,156 | 11/1968 | Mills | 414/607 |
| 4,295,772 | 10/1981 | Zimmerman | 414/789.2 |
| 4,325,669 | 4/1982 | Schafer | 414/608 X |
| 4,354,795 | 10/1982 | Dutra, Jr. | 414/622 |
| 5,156,519 | 10/1992 | Johansson | 414/607 X |

FOREIGN PATENT DOCUMENTS

| | | | |
|---|---|---|---|
| 2240633 | 2/1974 | Germany | 414/607 |
| 0021310 | 2/1980 | Japan | 414/27 |
| 0039303 | 5/1958 | Poland | 414/608 |
| 0337124 | 4/1959 | Switzerland | 414/639 |
| 0624461 | 6/1949 | United Kingdom | 414/622 |
| 1229490 | 4/1971 | United Kingdom | 414/607 |

OTHER PUBLICATIONS

Myers Tire Supply Catalog No. 325, p. 144 (1991).

*Primary Examiner*—Michael S. Huppert
*Assistant Examiner*—James W. Keenan

[57] ABSTRACT

Lift truck accessories for stacking and moving stacks of tires are disclosed. The tire-stacking device includes an elongated platform upon which a plurality of tires may be placed side by side when the device is in its horizontal position. The tire-stacking device can be raised by the lifting apparatus of a lift truck from its horizontal position to a vertical position. When in its vertical position, the stack of tires is supported by a clamping arrangement that is attached to the base end of the tire-stacking device. A second embodiment of the invention is a tire transporter that is always maintained in a vertical position but includes a clamping arrangement which is similar to the tire-stacking device. The tire transporter is relatively shorter than the kite-stacking device and enables a lift truck operator to move stacks of tires through low-clearance areas such as under doorways as well as into and out of trucks.

20 Claims, 20 Drawing Sheets

LIFT TRUCK ACCESSORIES FOR STACKING AND MOVING STACKS OF TIRES

This application is a continuation-in-part of co-pending United States patent application Ser. No. 07/917,779, filed on Jun. 21, 1992 and entitled TIRE-STACKING DEVICE, now abandoned.

BACKGROUND OF THE INVENTION

This invention relates generally to devices for use in cooperative arrangement with a lift truck, and in particular, to stacking and transporting devices for use in stacking and moving stacks of tires.

In the truck tire retreading business, used truck tires are normally brought into the plant and then are stacked on pallets eight tires high until the tires are ready for processing. Because these tires weigh on the order of 125 pounds each, they are generally too heavy for a single man to lift and place the last few tires on the top of a stack. Thus, it often requires two men to complete each eight-tire stack. After being stacked on a pallet, the tires can be moved about the plant by a single man using an ordinary forklift truck.

The present method of manually stacking tires on pallets suffers from two distinct drawbacks. First, it is inefficient to require the use of two persons to stack the tires. This inefficiency is even more significant when one realizes that the second person is only needed to stack the last few tires but is not needed to begin the stack of tires or to move the tires around the plant once stacked. Second, when only a single person is available to stack the tires, that person runs the risk of injury due to overexertion in having to stack heavy tires to heights above their chest level.

What is needed are tire-stacking and transporting devices that are capable of being used without pallets in conjunction with a forklift truck and which enable a single person to stack tires and transport the stack in an efficient manner without running the risk of injury due to overexertion.

SUMMARY OF THE INVENTION

One embodiment of the present invention comprises a tire-stacking device for use in cooperative arrangement with a lift truck having a lifting apparatus. The tire-stacking device is built around a frame having a base, a lifting end and a platform extending between the ends. The platform is capable of supporting a plurality of tires in side-by-side relation when the frame is in a horizontal position. A lateral support structure having a root end, a free end and a support surface positioned between the ends has its root end attached to the base end of the frame. The free end of the lateral support structure extends away from the platform. The support surface of the lateral support structure is capable of supporting the plurality of tires when the frame is in a vertical position. The tire-stacking device also includes roller means attached to the base end of the frame. Also included is means for releasably connecting the lifting end of the frame to the lifting apparatus of the lift truck. Finally, the tire-stacking device includes means for preventing the base end of the frame from swinging away from the lift truck when the frame is in its vertical position.

Another embodiment of the present invention comprises a tire transporter for use in cooperative arrangement with a lift truck having a lifting apparatus. The tire transporter is built around a vertical frame having a length and a base end. A horizontal support structure is attached to the base end of the frame and includes a support surface capable of supporting a stack of tires. The horizontal support structure includes a pair of gripping arms having root ends pivotably attached to the base end of the frame. Each of the arms has a free end extending away from the frame that includes a portion of the support surface. The arms are capable of pivoting toward and away from each other. The tire transporter also includes means for releasably connecting the frame to the lifting apparatus of the lift truck.

One object of the present invention is to provide improved methods and apparata for stacking and moving stacks of tires.

Related objects and advantages of the present invention will be apparent from the following description.

DESCRIPTION OF THE PREFERRED EMBODIMENTS

Figure 1:
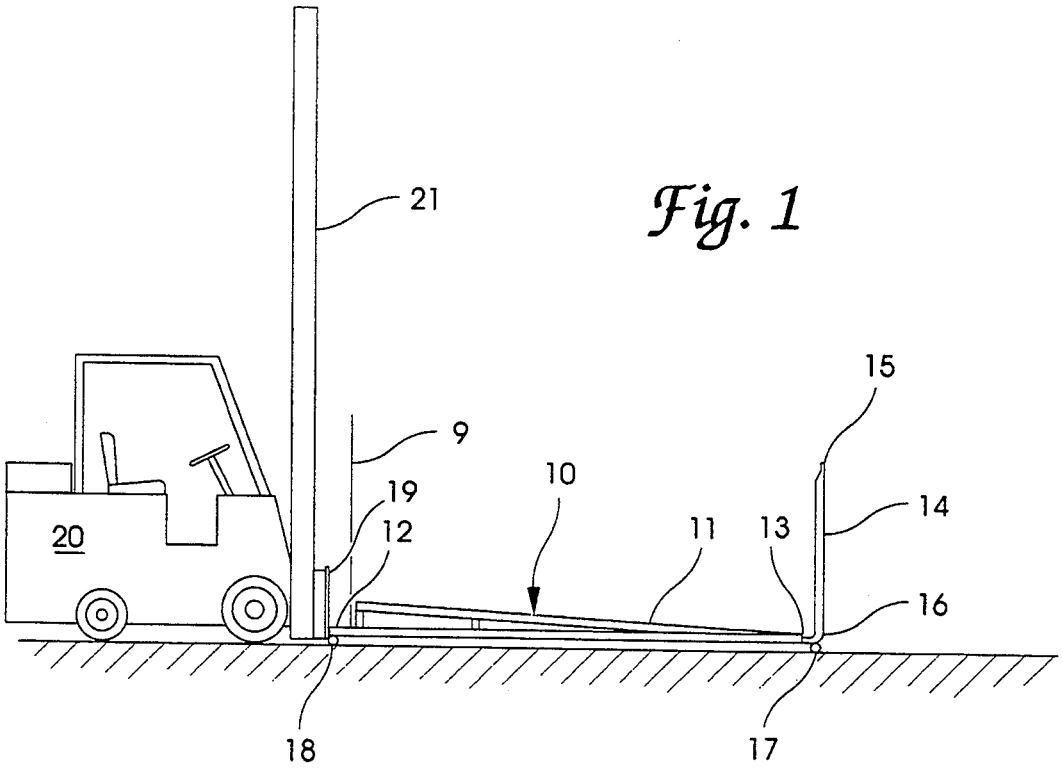
FIG. 1 is a side elevational view of a tire-stacking device in its horizontal position attached to the lifting apparatus of a lift truck.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
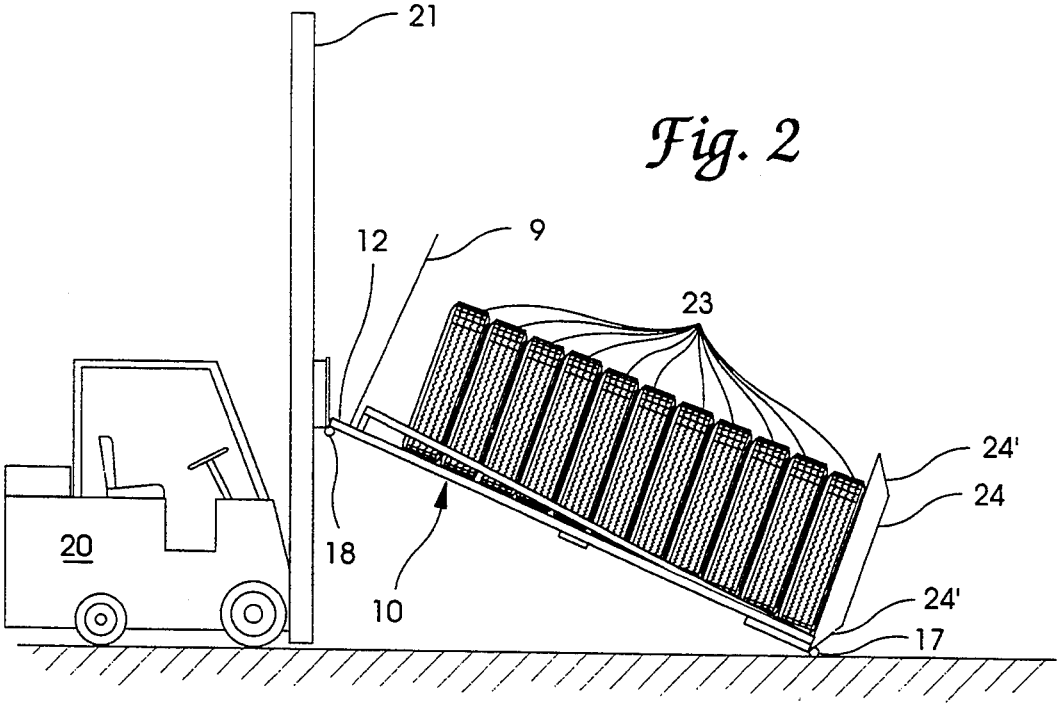
FIG. 2 is a side elevational view of the tire-stacking device of FIG. 1 after a plurality of tires has been arranged thereon and the lifting apparatus of the lift truck has been activated.
Figure 3:
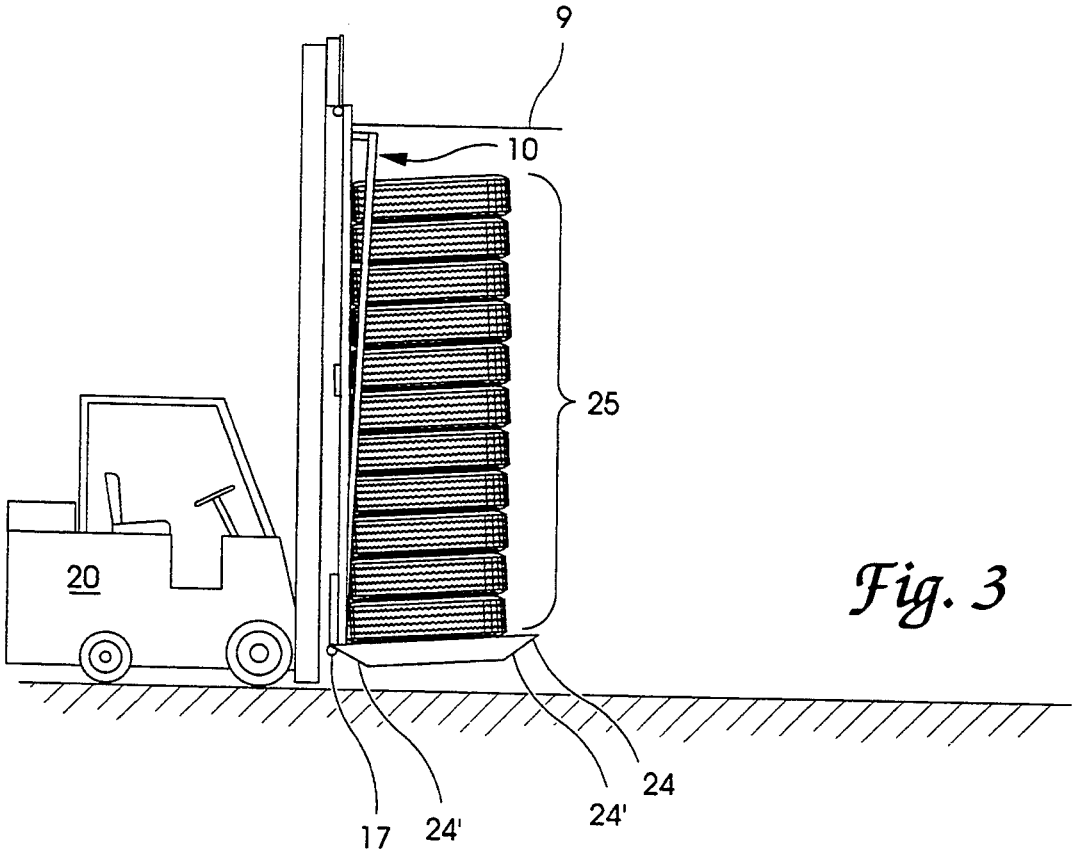
FIG. 3 is a side elevational view of the tire-stacking device of FIG. 1 shown in its vertical position holding a stack of tires.

Referring now to FIGS. 1–3, there is illustrated a tire-stacking device 10 being used in cooperative arrangement with a lift truck 20. Tire-stacking device 10 includes a frame 11 having a lifting end 12 and a base end 13. A pair of forks 14, which act as a lateral support structure, are attached to the base end 13 of frame 11. Forks 14 are attached such that the free end 15 of the forks projects perpendicularly away from frame 11. A pair of wheels 17 are attached to the root end 16 of the forks 14. The lifting end 12 of tire-stacking device 10 is connected to the lifting apparatus 21 of lift truck 20 via an adapter 19. Adapter 19 includes at least one hook 18 that attaches to lifting end 12 via cross members 30, which are better shown in FIG. 4.

With the tire-stacking device in its horizontal position as shown in FIG. 1, the worker simply places an ordinary but slightly modified wooden pallet 24 over forks 14, and then arranges a plurality of tires 23 in side-by-side relation along the top platform portion of frame 11. Note that the bottom end slats of the pallet 24 are cut back or removed and the ends of the rails making up the pallet are bevelled so that bottom corners 24′ of the pallet are bevelled. The worker then activates lifting apparatus 21 of lift truck 20 with the lifting end 12 of tire-stacking device 10 attached thereto via adapter 19. As the lifting end 12 of tire-stacking device 10 is lifted off the ground, base end 13 of the tire-stacking device moves toward the lift truck 20 on wheels 17, as shown by the arrows in FIG. 2. In order to get tire-stacking device 10 into its vertical position, the lifting apparatus of the lift truck must have a vertical lift height greater than the length of the tire-stacking device. FIG. 3 shows tire-stacking device 10 in its vertical position with a plurality of stacked tires 25 supported thereon. The worker can then simply drive the lift truck to any location to deposit the new stack of tires 25.

In order to deposit the stack of tires 25, the lifting apparatus is lowered until pallet 24 contacts the ground. The lift truck is then backed away from the pallet and the new stack of tires 25 is left standing alone with the tire-stacking device 10 remaining attached to the lift truck 20. Thus, the tire-stacking device enables a single person with the aid of a lift truck to stack a plurality of tires on a pallet without requiring significant amounts of lifting on the worker's part.

Figure 4:
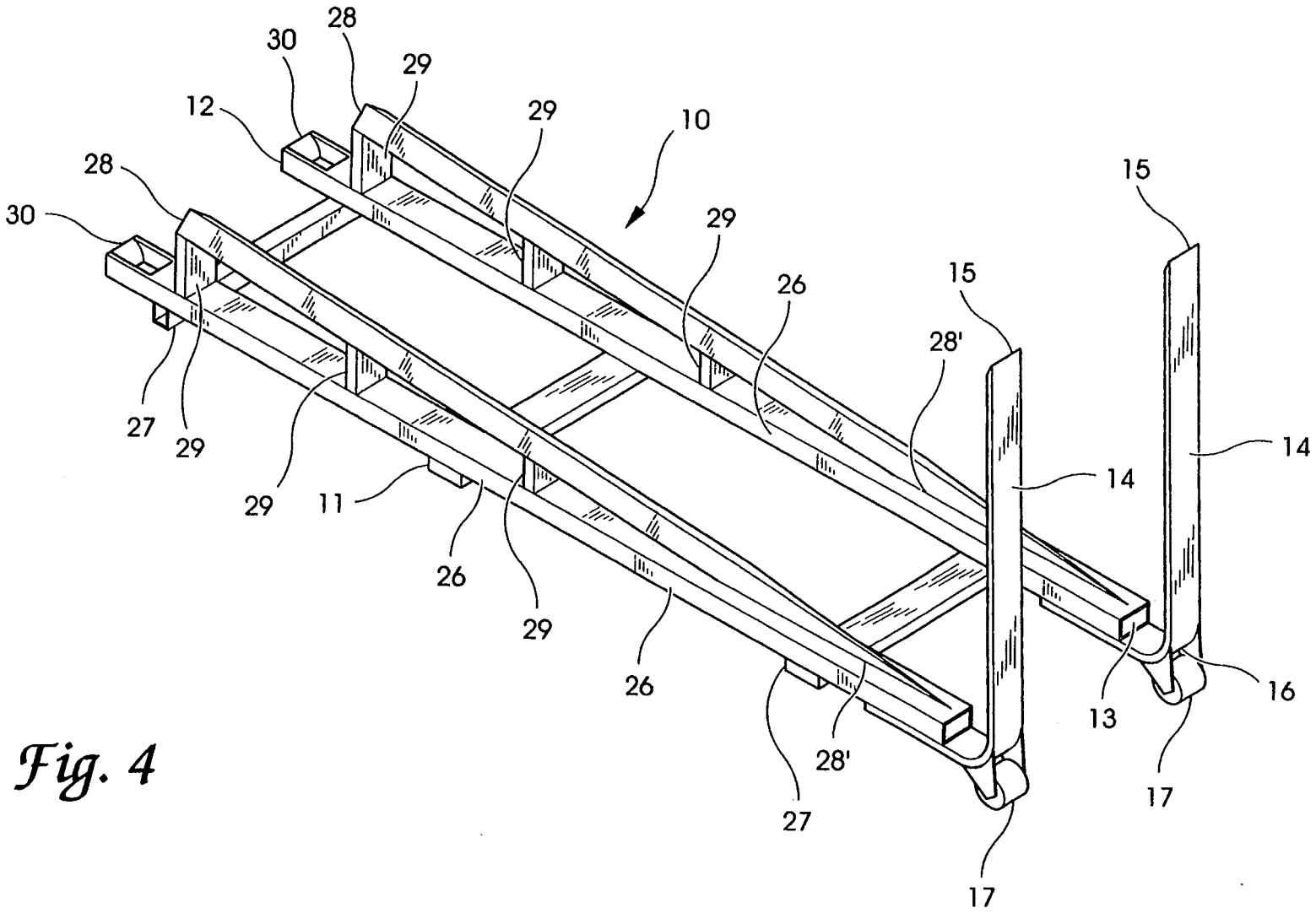
FIG. 4 is an isometric view of a tire-stacking device.

FIG. 4 shows in greater detail the various components which go into making up tire-stacking device 10. In particular, frame 11 includes a pair of elongated metallic rails 26 that are rigidly interconnected by a plurality of bracing members 27 along its length. A pair of spaced apart angle irons or support rails 28 are fixedly supported on the top of rails 26 via a plurality of vertical support members 29 fixed to and extending therebetween. Angle irons 28 act as a platform for the tires when the device is in its horizontal position. Vertical support members 29 and angle irons 28 are arranged such that the platform gently slopes downward toward the base end 13 of frame 11. A pair of cross members 30 are attached to the lifting end 12 of rails 26. Lateral support is provided by a pair of lifting forks 14 which are fixedly attached one each to the base end 13 of rails 26. Forks 14 extend substantially perpendicular to rails 26 but form a slightly acute angle with angle irons 28. A pair of wheels 17 are rotatably mounted to the root end 16 of each of the forks 14 and serve as a support for the base end of the tire-stacking device. The various components making up the frame including the rails 26 and 28, the members 29, cross members 30 and bracing members 27 as well as the forks 14 are preferably made from metal and welded together.

Figure 6:
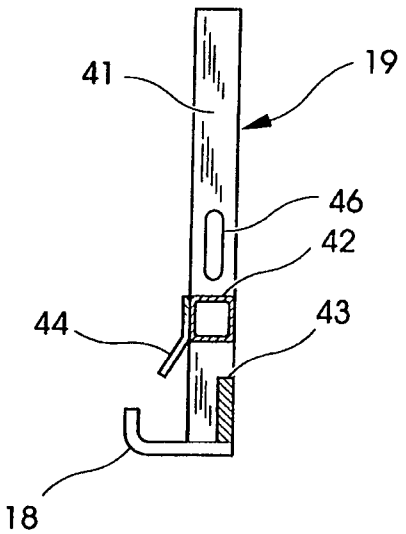
FIG. 6 is a sectional view of the adapter shown in FIG. 5 taken along the line 6—6 of FIG. 5.
Figure 5:
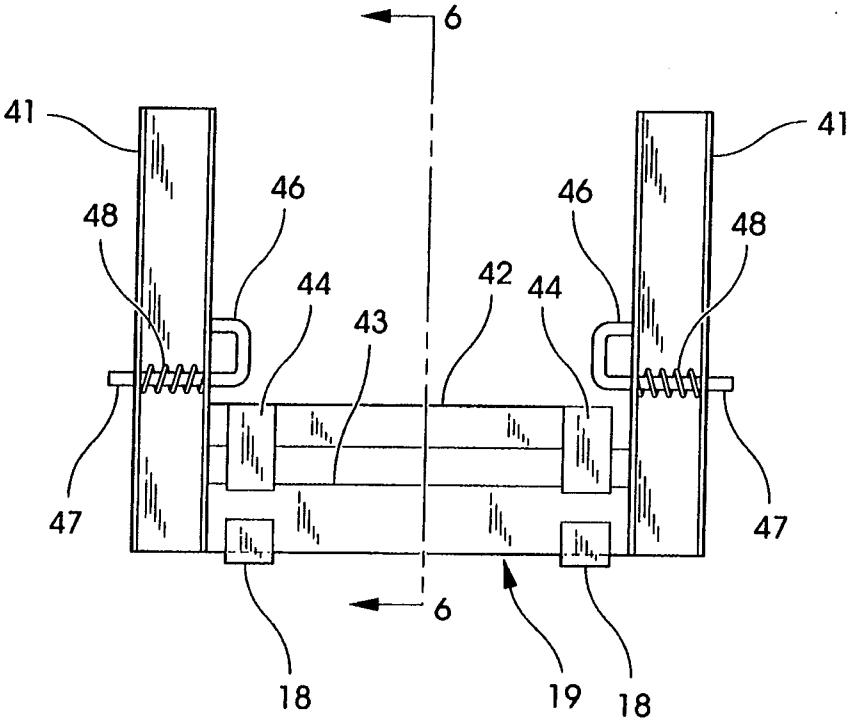
FIG. 5 is a front elevational view of an adapter which is connected between the lifting apparatus of the lift truck and the tire-stacking device of FIGS. 1–4.

FIG. 5 shows a detailed front view of adapter 19 which is attached to the lifting apparatus of the lift truck to enable the lift truck to lift the tire-stacking device of FIG. 4. Adapter 19 includes a pair of vertically disposed I-beam members 41 which are fixedly connected together via cross braces 42 and 43. A pair of spring-biased pins 46 extend through the front portion of I-beam members 41 such that each pin 46 includes a protrusion 47 which enables the adapter to be attached to the lifting apparatus of the lift truck. Pins 46 are biased via springs 48 so that the protrusions 47 extend oppositely and outboard of adapter 19. Pins 46 are arranged in size to mate to the lifting apparatus of a lift truck via protrusions 47. A pair of hook members 18 are fixedly attached to cross member 43 in a spaced apart relation that corresponds to the distance apart of cross members 30 on the lifting end 12 of the tire-stacking device 10 (see FIG. 4). Directly above hooks 18 are retaining members 44 which are attached to cross brace 42 and serve to help prevent the cross members 30 from inadvertently escaping from hooks 45 while the stack of tires is being lifted, transported and/or deposited by the lift truck. FIG. 6 shows in side view the preferred shape of retainer 44 and hooks 45.

Figure 7:
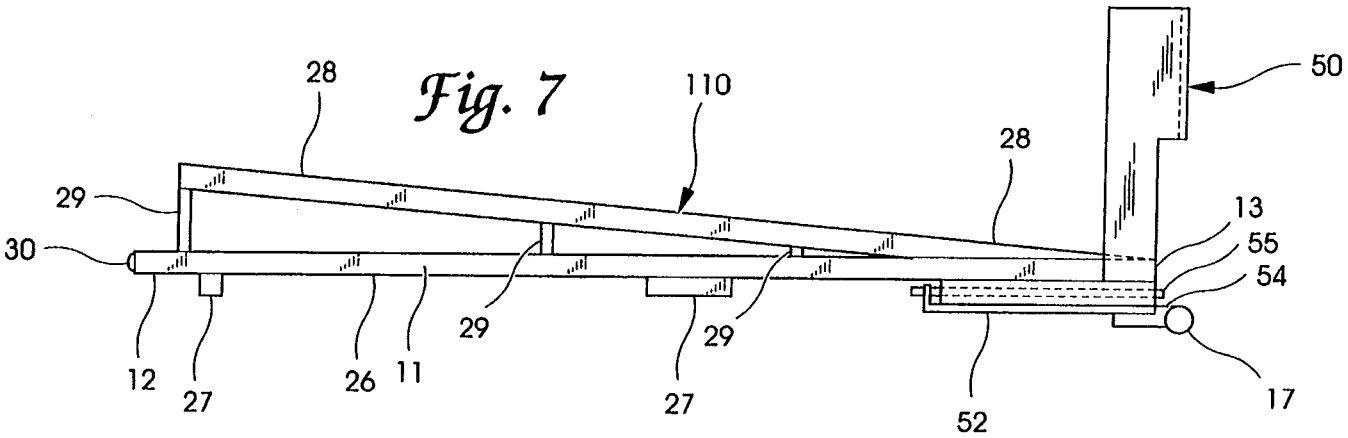
FIG. 7 is a side elevational view of another tire-stacking device.
Figure 9:
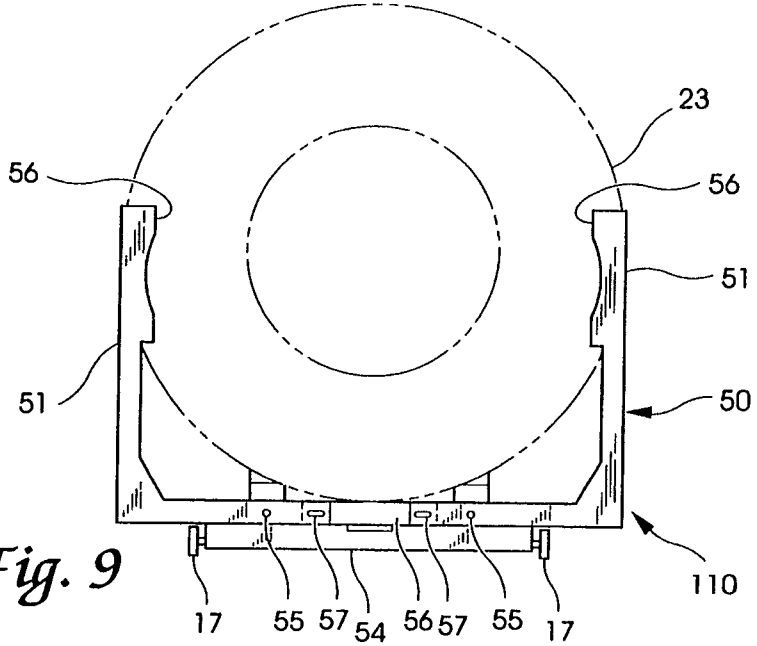
FIG. 9 is an end elevational view of the tire-stacking device of FIG. 7 shown with the clamping mechanism in its closed position about a tire.
Figure 8:
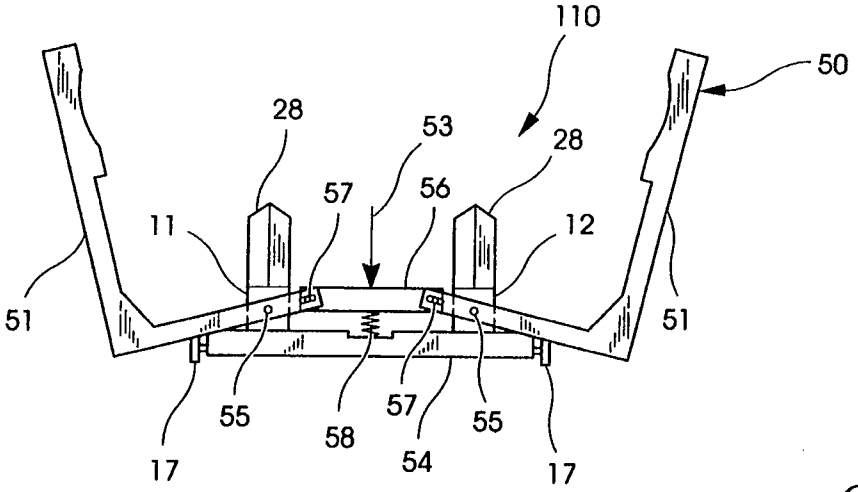
FIG. 8 is an end elevational view of the tire-stacking device shown in FIG. 7 with the clamping mechanism in its open position.

FIGS. 7–9 illustrate an alternative tire-stacking device that utilizes a clamping mechanism 50 in place of the forks 14 of the embodiment discussed earlier. Like the embodiment discussed earlier, tire-stacking device 110 includes a frame 11 which is made up of a pair of elongated rails 26 held together by a plurality of cross support members 27. Angle irons 28, which act as a platform for the tires, are then supported above rails 26 via a plurality of vertical support members 29. Like the embodiment discussed earlier, angle irons 28 are arranged in a slight sloping pattern which has been found to better facilitate the use of the device. Also like the device discussed earlier, tire-stacking device 110 includes a pair of cross members 30 which are attached to the lifting end 12 of frame 11 in a spaced apart relation in order to correspond to hooks 45 on adapter 19 which is shown in FIGS. 5 and 6. Tire-stacking device 110 also includes a pair of wheels 17 which are rotatably mounted adjacent base end 13 of the device.

As best seen in FIGS. 8 and 9, clamping arrangement 50 includes a pair of grasping arms 51 which each pivot about a pivot pin 55, which pins are attached to frame 11. Arms 51 are interconnected by a pressure plate 56 via a pin and slot arrangement 57. Compression spring 58 is disposed between cross member 54 and pressure plate 56 in such a way that arms 51 are biased into an open position as shown in FIG. 8. The weight of a tire placed on pressure plate 56 acts in the direction of arrow 53 which causes spring 58 to compress and arms 51 to swing closed into their closed position as shown in FIG. 9. Arms 51 each include a lateral support portion 56 which serves to support the stack of tires when the tire-stacking device 110 is in its vertical position.

Tire-stacking device 110 is used in a manner similar to the device discussed earlier except no wooden pallet is required when clamping arrangement 50 is used in place of forks 14 of the previous embodiment. Instead, the first tire is merely placed adjacent the base end 13 of the tire-stacking device to activate the clamping arrangement 50 in order to hold the first tire in place. The remaining tires are arranged in a side-by-side relation to the first tire as in the embodiment discussed earlier. Next, the lift truck is connected to the lifting end 12 of the tire-stacking device via adapter 19 as discussed earlier. The stack of tires are then hoisted into a vertical position as shown in FIGS. 1–3. The stack of tires can then be moved to any location using the lift truck. After arriving at the desired location, the worker lowers the lifting apparatus of the lift truck sufficient that the first tire begins to come in contact with the ground or with a pallet. As the first tire comes in contact with the ground, the weight of the stack of tires no longer acts against the arms to hold them in gripping relation whereupon compression spring 58 causes the arms to once again swing open to their open position as shown in FIG. 8 thus releasing the stack of tires from the tire-stacking device 110.

The tire-stacking device of the present invention can also be used in cooperative arrangement with a lift truck in order to move previously stacked tires to a new location. When using the tire-stacking device to simply move stacks of tires, the worker merely connects the tire-stacking device to the lifting apparatus of the lift truck and raises the tire-stacking device into its vertical position as shown in FIG. 3. However, unlike what is shown in FIG. 3, there would be no stack of tires 25 or pallet 24 being carried by the tire-stacking device. The operator then drives the lift truck to approach a stack of tires with the lateral support structure of the tire-stacking device extending in front of the lift truck.

It should be noted that the rod 9 shown in FIGS. 1–3 which protrudes away from tire-stacking device adjacent lifting end 12 provides a fork truck operator with a visual guide so that he can estimate approximately where the hooks 18 are because the same is normally hidden from his view. Utilizing the visual guide 9, the fork truck operator then positions the hooks 18 to engage the cross members 30.

If the stack of tires is on top of a pallet, the fork truck operator positions the forks 14 as discussed earlier in the pallet under the stack of tires. In the case of the clamping arrangement 50 shown with respect to tire-stacking device 110, the fork truck operator approaches the stack of tires until the bottom tire depresses pressure plate 53 thus activating the clamping arrangement 50 to clamp around the base tire of the stack of tires.

The lift truck operator then activates the lifting apparatus to raise the stack of tires which are then supported by the lateral support structure of the tire-stacking device. Next, the lift truck is driven to a new location and the lifting apparatus is activated to lower the stack of tires until the tires are no longer supported by the lateral support structure. Finally, the lift truck is backed away from the stack of tires to leave the tires at the new location.

Figure 10:
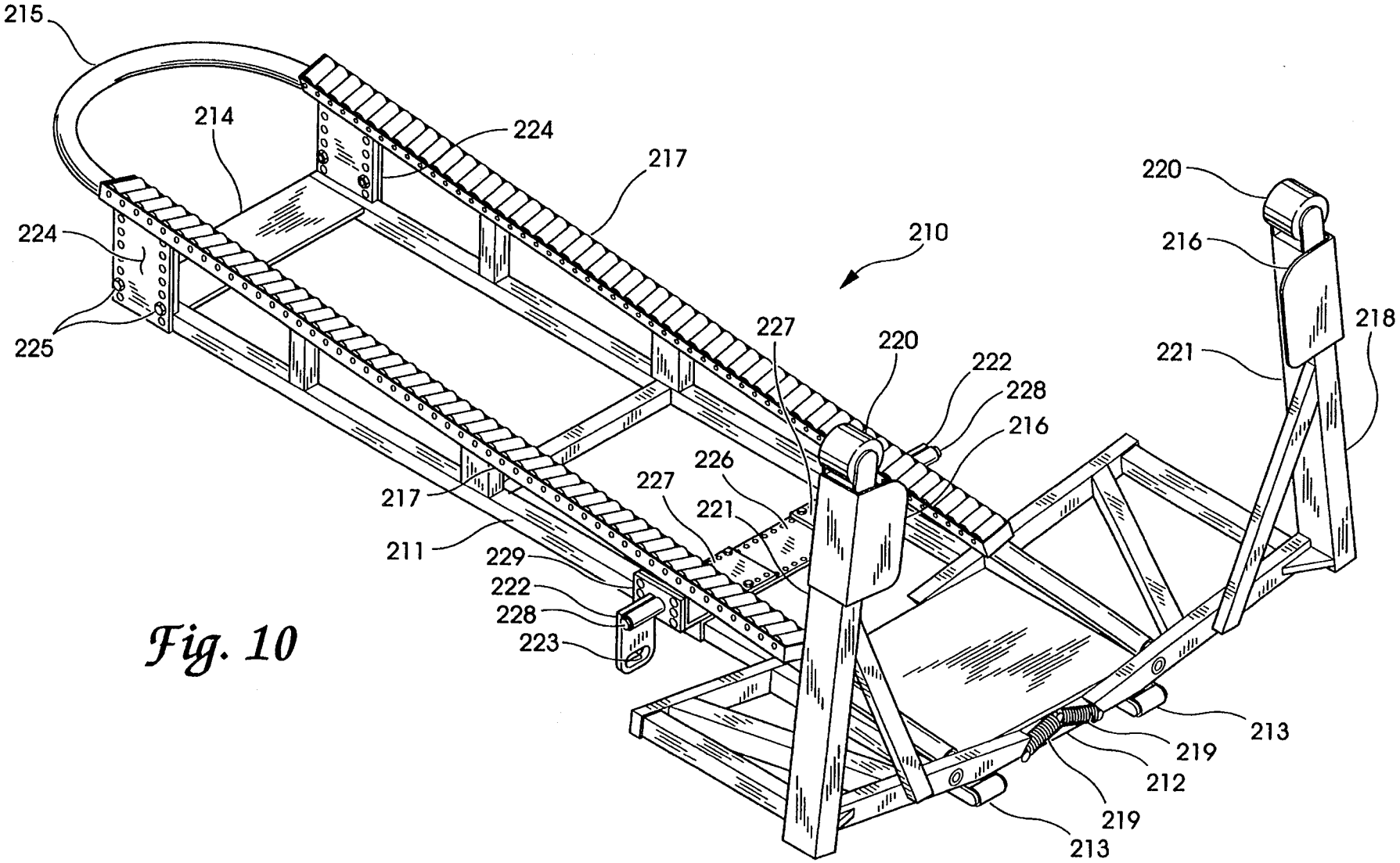
FIG. 10 is an isometric view of a tire-stacking device according to the preferred embodiment of the present invention.

FIG. 10 shows an improved tire-stacking device 210 according to the preferred embodiment of the present invention. The tire-stacking device is built around a frame 211 having a base end 212 and a lifting end 214 analagous to the embodiments discussed earlier. A pair of rollers 213 are attached adjacent the base end and rotatably support the device when being lifted from its horizontal position to a vertical position, as illustrated in FIGS. 1–3. Device 210 includes a pair of roller rails 217 in place of the angle irons 28 discussed with respect to the earlier embodiments. These rollers allow the stack of tires to settle when the device is lifted from its horizontal position to its vertical position. As in the embodiments discussed earlier, roller rails 217 serve as a platform upon which the tires can be arranged in side-by-side relation before the device is lifted to its upright vertical position.

An arcuate-shaped lifting bar 215 is attached to the lifting end 214 of frame 211 via an adjustable bracket 224. Bracket 224 and bolts 225 enable the arcuate-shaped lifting bar to have its height above the ground adjusted to accommodate different hook assemblies and lift trucks. Arcuate-shaped lifting bar 215 enables a single hook to lift tire-stacking device 210 instead of the dual hook design of the embodiments shown in FIGS. 1–9.

Tire-stacking device 210 also includes a clamping arrangement 218 which is similar to the clamping arrangement shown and described with respect to FIGS. 8 and 9, except that clamping arrangement 218 includes tension springs 219 which bias arms 221 toward one another. Thus, clamping arrangement 218 is virtually identical to the clamping arrangement described earlier except that the arms 221 are biased inward as opposed to outward as shown in FIG. 8. Like the embodiment described earlier, clamping arrangement 218 provides a lateral support structure for supporting the stack of tires when the device is in its vertical upright position. In particular, support surfaces 216, which are mounted on each arm, support the base tire in a stack of tires in a manner similar to that illustrated in FIG. 9. A roller 220 is mounted on the free end of each arm 221 and serves as a means for spreading the arms apart when the tire-stacking device approaches a stack of tires to be lifted. In other words, rollers 220 ride along the treads of the base tire in a stack of tires causing the arms 221 to spread apart as support surfaces 216 slip underneath the base tire. Tire-stacking device 210 also includes a pair of latch members 222 that are mounted on either side of frame 211 above clamping arrangement 218. Latch members 222, which are discussed infra, serve to prevent base end 212 of the tire-stacking device from swinging away from the lift truck when the device is lifted to its vertical position.

Figure 11:
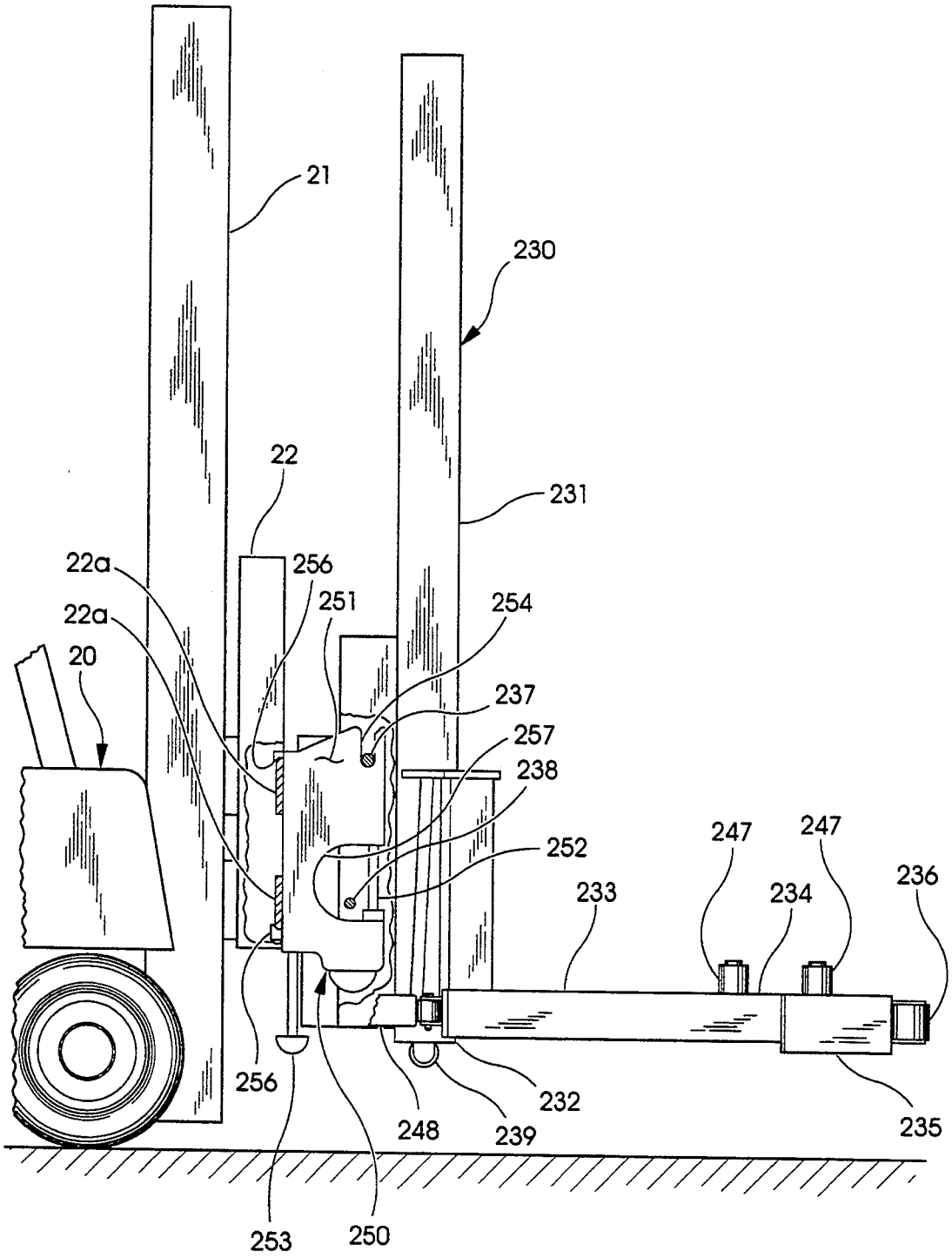
FIG. 11 is a partial side elevational view of a tire-transporting device according to another embodiment of the present invention attached to the lifting apparatus of a lift truck.
Figure 12:
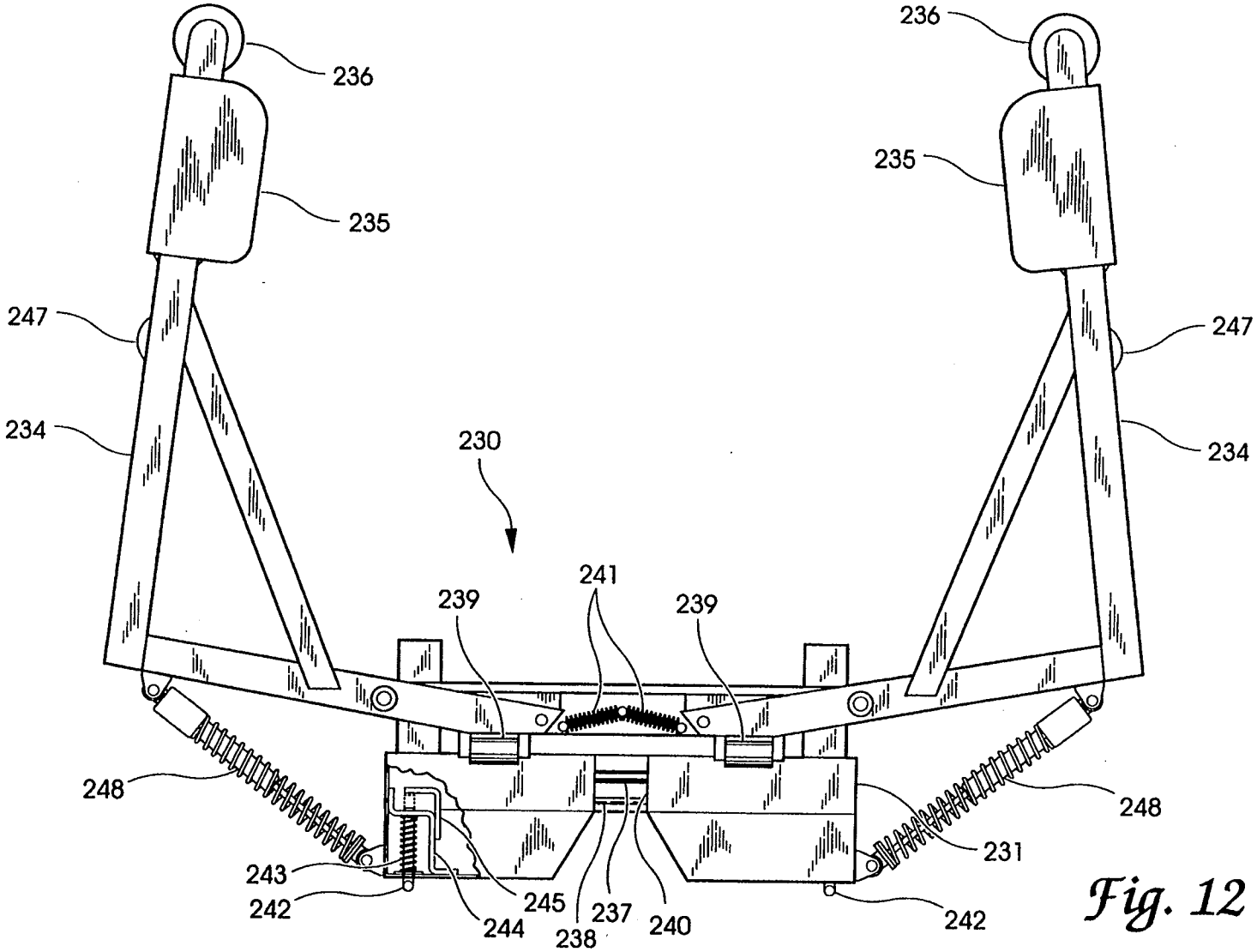
FIG. 12 is a bottom view of the tire-transporting device shown in FIG. 11.

Referring now to FIGS. 11 and 12, a tire-transporting device 230 according to another embodiment of the present invention is shown lifted just above the ground by a lift truck 20. Unlike the tire-stacking devices described earlier, transporting device 230 is always maintained in an upright position as shown and is used only for moving stacks of tires from one place to another. Transporting device 230 includes a clamping arrangement 233 that is substantially identical to the clamping arrangement 218 of tire-stacking device 210 previously described. However, unlike the clamping arrangement described earlier, the transporting device includes a pair of ordinary automotive shock absorbers that serve essentially as compression springs to strengthen the inward bias of arms 234. This added feature better enables device 230 to approach and clamp onto a stack of tires. Clamping arrangement 233 is also different from the embodiments discussed earlier in that it includes the addition of guide rollers 247 mounted on each of the arms 234. Rollers 247 better enable device 230 to back away from a stack of tires without dragging the stack due to the added bias of shock absorbers 248. Clamping arrangement 233 is attached to a relatively short vertical frame 231 that enables lift truck 20, to move a stack of tires through low clearance areas. In other words, the relatively short vertical frame 231 combined with a relatively short mast 21 of lift truck 20 enables one to move a stack of tires through doorways as well as in and out of trucks. Movement of stacks of tires through low-clearance areas would be substantially impossible with the relatively longer tire-stacking devices previously described.

Figure 17:
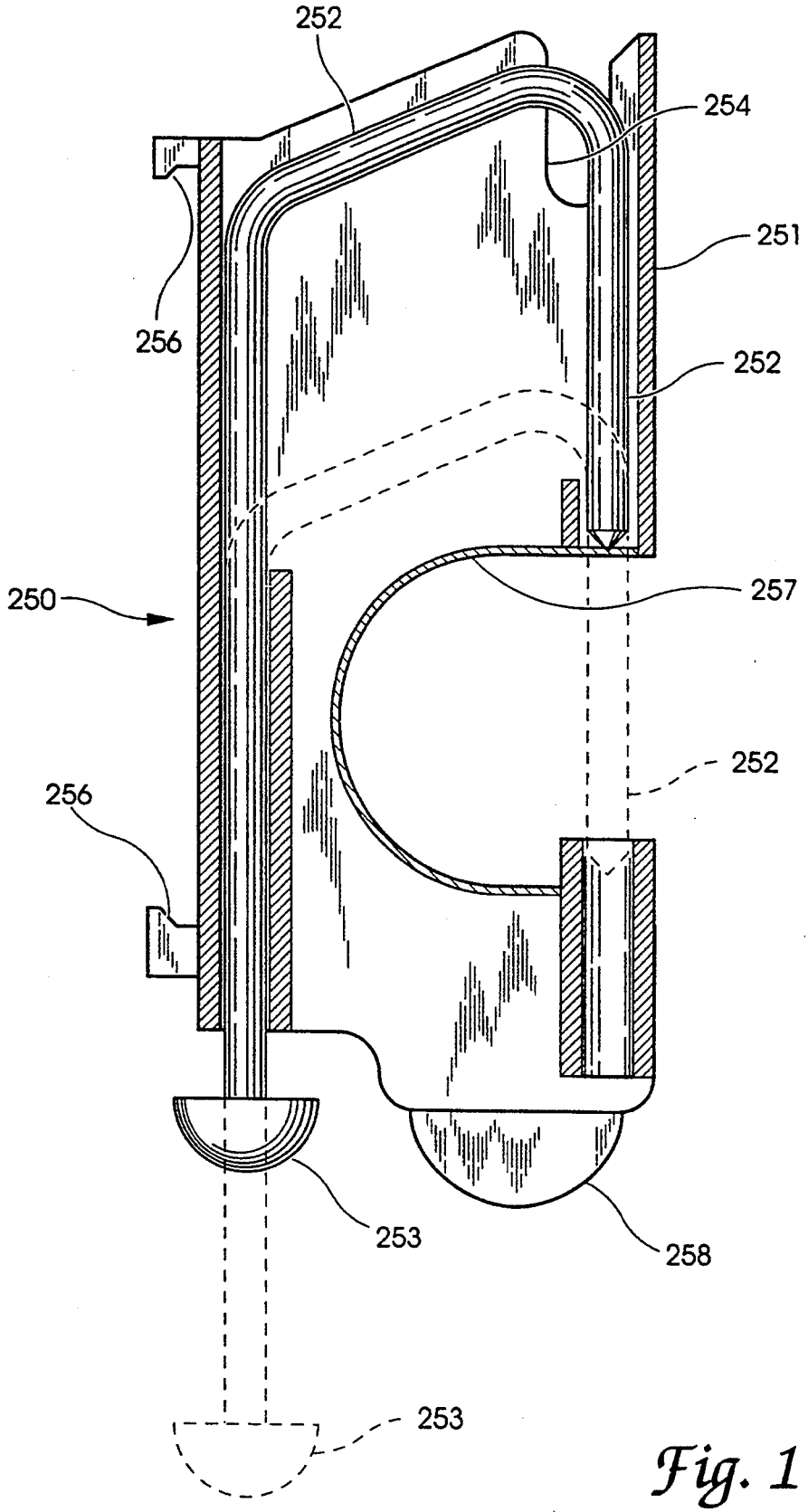
FIG. 17 is a fully sectioned side elevational view of a hooking assembly according to one aspect of the present invention.

Transporting device 230 is connected to the lifting apparatus 22 of the lift truck 20 via a hook assembly 250 (see FIG. 17). Hook assembly 250 includes a pair of mounting flanges 256 that enable the assembly to be attached to the front of lifting apparatus 22 via a pair of cross plates 22*a*. The weight of transporting device 230 is supported by hook 254 via a lifting pin 237 that is mounted in the lower portion of vertical frame 231 in a channel 240 as best seen in FIG. 12. The transporting device also includes a base pin 238 that is also mounted within channel 240. Base pin 238 becomes trapped within cavity 257 of hook assembly 250 when pin 252 drops to its closed position. By being trapped within cavity 257, base pin 238 acts as a backup hook that prevents transporter device 230 from becoming accidentally disconnected from the lift truck in the event that lifting pin 237 fails.

When standing alone unhooked from a lift truck, transporting device 230 is supported by a pair of rollers 239 and the underside of support surfaces 235. When hooked to a lift truck, the rear side of vertical frame 231 is held slightly away from the front face of the lifting truck by spring-loaded upright bars 242. Upright bars 242 are biased outward by compression springs 243, which are attached to frame 231 via mounting bracket 244. Channel guides 245 are also mounted within vertical frame 231 and enable upright bars 243 to slide from an extended position as shown to a position flush with the back surface of frame 231. When approaching a stack of tires to be lifted, the rollers 236 and rollers 247 mounted along free ends of arms 234 ride against the tread of the base tire to spread the arms apart. Thus, arms 234 are spread apart against the action of tension springs 241 and shock absorbers 248, which normally maintain the arms biased toward one another as shown in FIG. 12. The base tire in a stack of tires is supported by support surfaces 235 as in the tire-stacking devices previously described.

Referring now to FIGS. 13–17, the unique structure of hook assembly 250 enables it to be used interchangeably with tire-stacking device 210 and tire-transporting device 230. In fact, the sliding pin action of hook assembly 250 enables a lift truck operator to connect and disconnect the lifting apparatus 22 of a lift truck to both the tire-stacking device 210 and the transporting device 230 without ever having to step off of the lift truck. Sliding pin 252 is capable of moving between a retracted position and a closed position as shown in shadow in FIG. 17. Normally, the weight of sliding pin 252 maintains it in its closed or locked position. However, when the lifting apparatus of the lift truck is lowered near the ground, push knob 253 comes in contact with the ground and causes sliding pin 252 to retract to its open position. A plastic knob 258 is attached to the underside of housing 251 and slides along the ground when the lift truck is being connected or disconnected from either the stacking device 210 or the transporting device 230. Housing 251 includes a pair of mounting flanges 256 which enable hook assembly 250 to be attached to the lifting apparatus of a lift truck.

Figure 13:
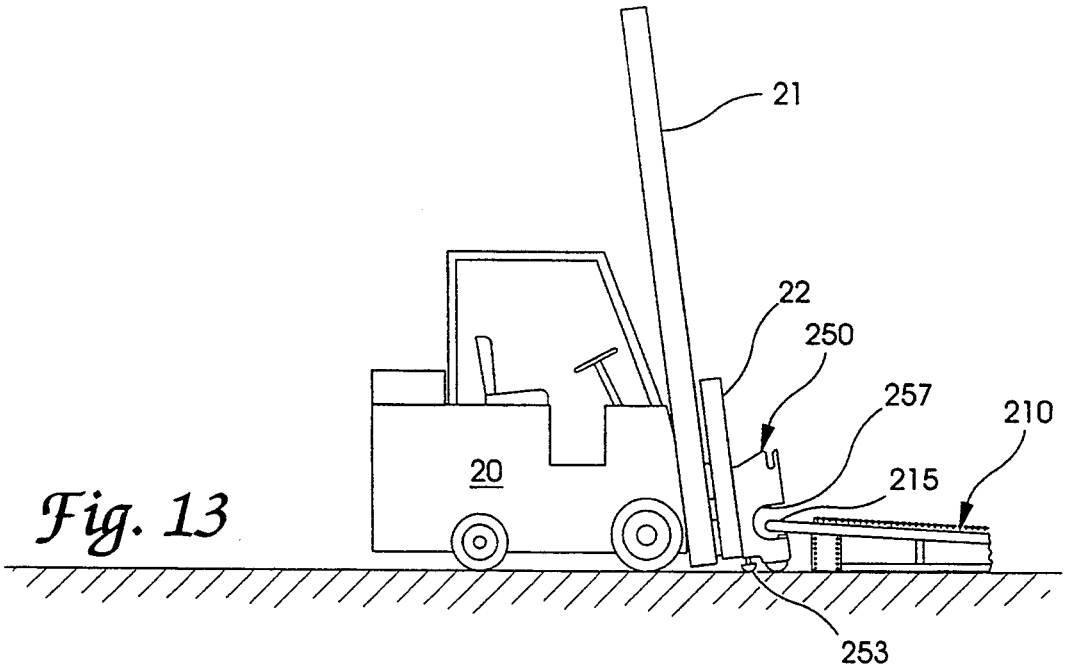
FIG. 13 is a side elevational view of a lift truck being unhooked from the tire-stacking device of FIG. 10.
Figure 14:
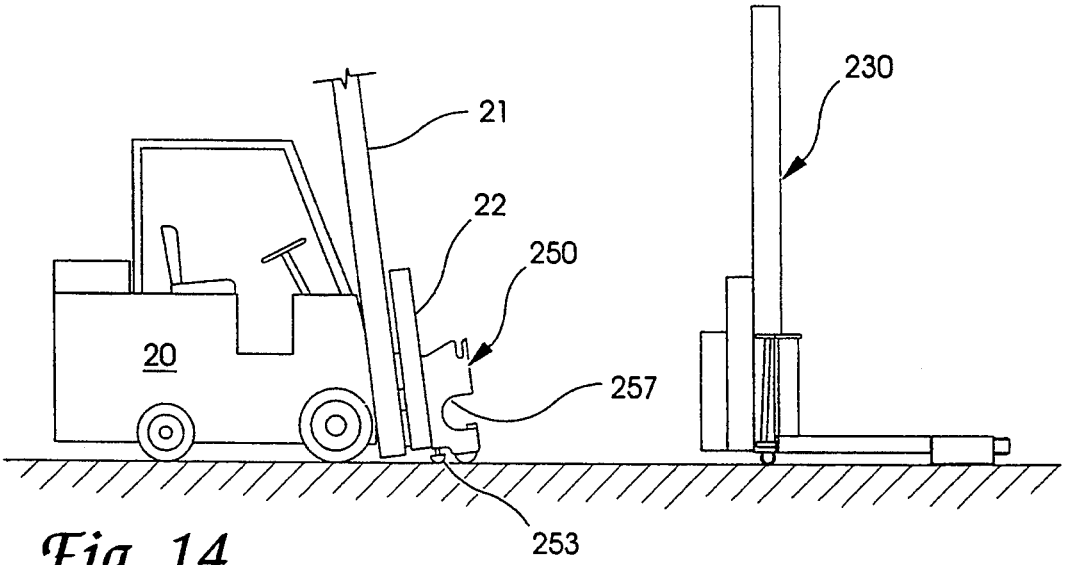
FIG. 14 is a side elevational view of the lift truck of FIG. 13 approaching the tire-transporting device of FIGS. 11 and 12.

Because sliding pin 252 of hook assembly 250 naturally slides to its closed position when the assembly is lifted above the ground, tire-stacking device 210 can only be connected and disconnected from the lift truck 20 when the device is in its horizontal position as shown in FIG. 13. When hooking up to the tire-stacking device, the lift truck operator lowers the lifting apparatus 22 until plastic knob 258 of hook assembly 250 contacts the ground so that push knob 253 has moved sliding pin 252 to its retracted position. Depending upon the particular lift truck being used, the operator may also have to slant the mast 21 in order to get pin 252 sufficiently retracted to unhook from the tire-stacking device 210. The lift truck operator then drives the lift truck forward until arcuate-shaped lifting bar 215 is received within cavity 257 of hook assembly 250. The operator then places a plurality of tires on tire-stacking device 210 and lifts the stack into its vertical upright position as illustrated in FIGS. 1–3. The operator then moves the stack of tires to a desired location and deposits them there by lowering the lifting apparatus until the base tire of the stack is no longer supported by the support surfaces 216 (FIG. 10) of the clamping arrangement 218. The lift truck operator then backs away from the stack of tires with the tire-stacking device still in its upright position.

Figure 15:
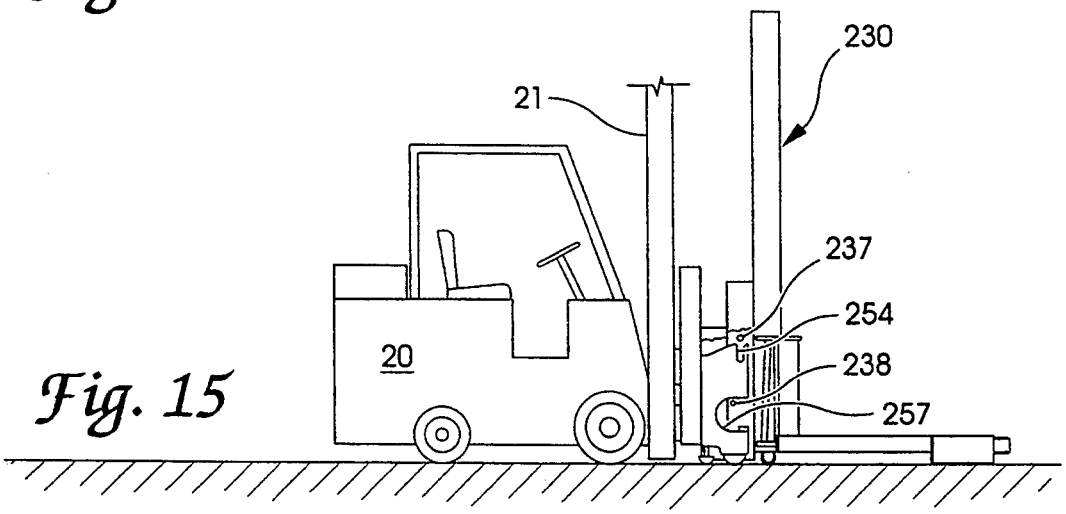
FIG. 15 is a side elevational view of the lift truck of FIG. 14 hooking up to the tire-transporting device of FIGS. 11–13.

The operator can then disconnect from the tire-stacking device 210 by lowering it into its horizontal position so that the sliding pin of the hook assembly 250 is moved to its retracted position and arcuate-shaped lifting bar 215 can be withdrawn from cavity 257. With the lift truck 20, lifting apparatus 22 and the tire-stacking device in the configuration shown in FIG. 14, the lift truck operator then simply backs away from tire-stacking device 210. If the lift truck operator then desires to connect the lift truck 20 to a tire transporting device 230, he approaches the device with the lifting apparatus 20 and the hook assembly 250 in the configuration shown in FIG. 15. The operator then advances the lift truck forward until hook assembly 250 is received within channel 240 (FIG. 12) so that hook 254 is positioned underneath lifting pin 237 of tire transporter 230. At the same time, base pin 238 is received within cavity 257 as shown in FIG. 15. The connection is completed by raising the lifting apparatus of the lift truck sufficiently that lifting pin 237 is received within hook 254 and sliding pin 252 of hook assembly 250 has dropped sufficiently to trap base pin 28 within cavity 257.

Figure 16:
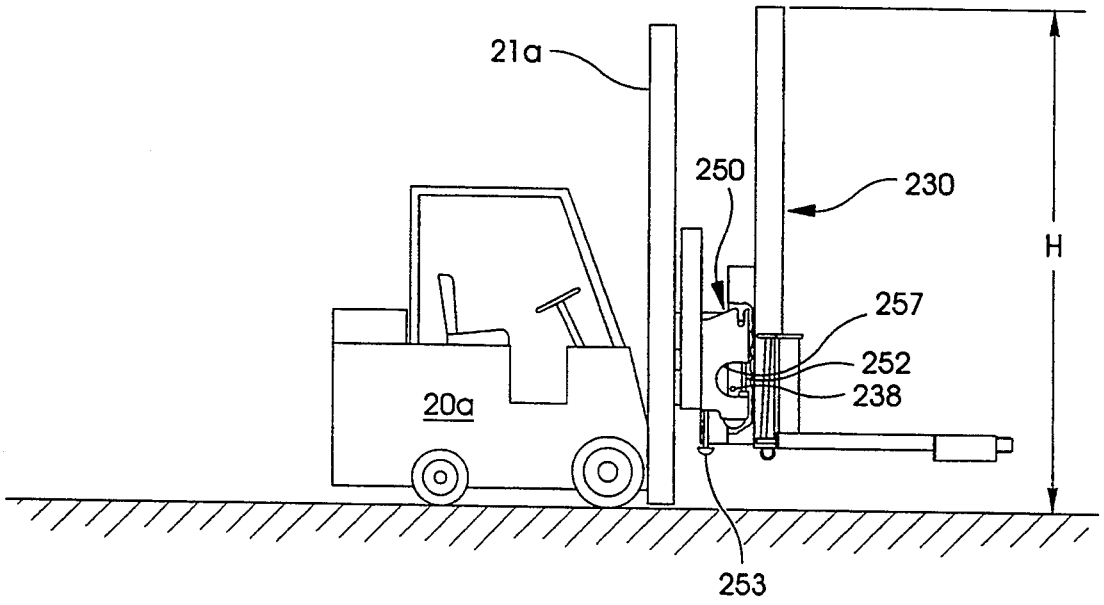
FIG. 16 is a side elevational view of a lift truck having a shortened mast attached to the tire-transporting device of FIGS. 11 and 12.

The operator then approaches a stack of tires with support surfaces 235 (FIG. 12) sliding under the base tire to support the stack. When using a lift truck 20*a* having a relatively short mast 21*a* as shown in FIG. 16, the lift truck operator can utilize the tire-transporting device 230 to move stacks of tires in and out of low-clearance areas such as through doorways, as well as in and out of trucks. When depositing a stack of tires, the operator lowers the stack until the base tire is no longer supported by the support surfaces 235 (FIG. 12), and then backs away from the stack of tires.

Figure 18:
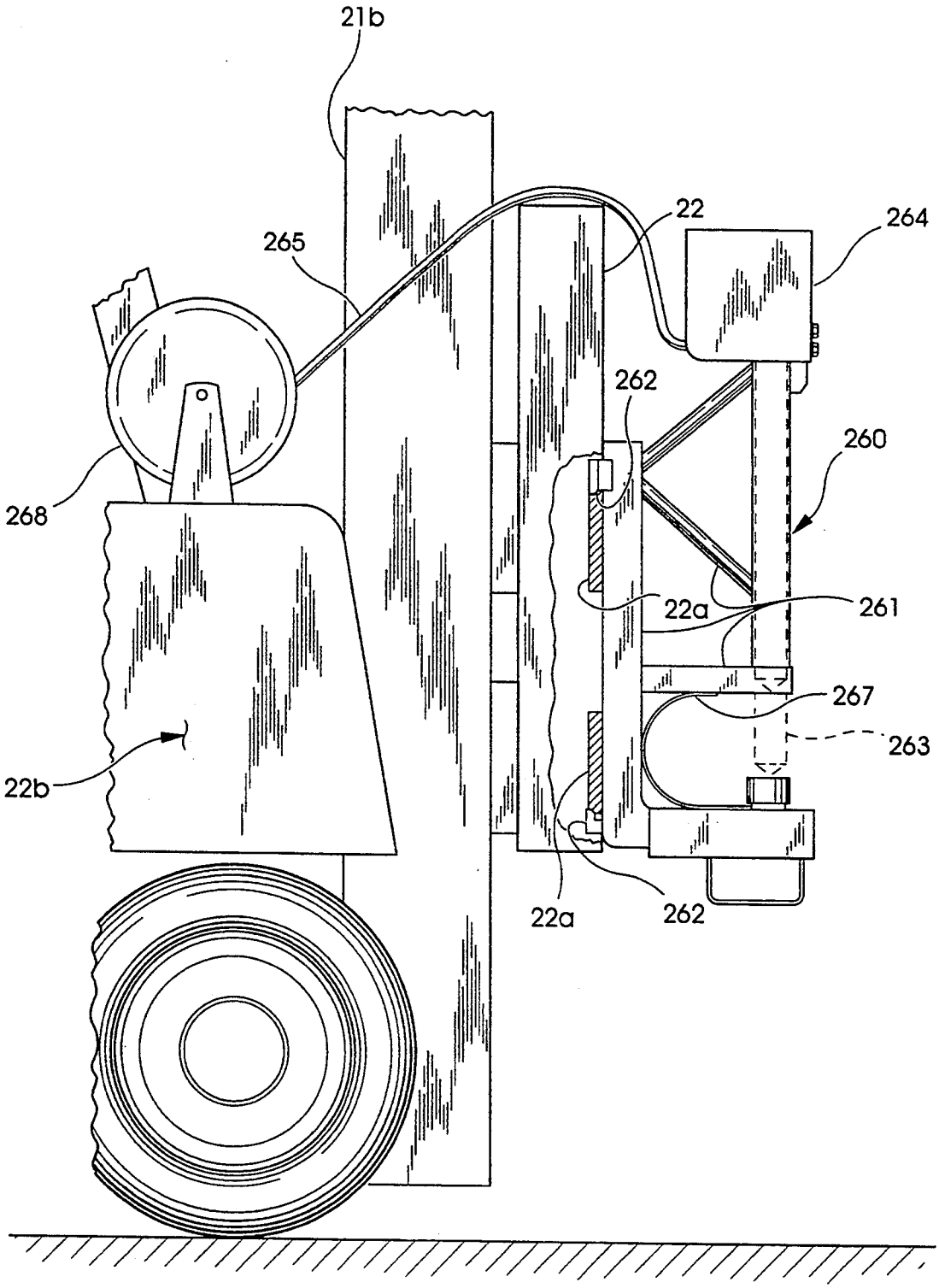
FIG. 18 is a partial side elevational view of a lift truck having an alternative hook assembly attached thereto according to another aspect of the present invention.

Referring now to FIG. 18, an alternative hook assembly 260 is shown attached to the front of the lifting apparatus 22 of a lift truck in the same way described earlier with respect to hook assembly 250. In other words, hook assembly 260 includes a pair of mounting flanges 262 which grip a pair of cross plates 22*a* mounted across the face of lifting apparatus 22. Because of the configuration of hook assembly 260, it is only useful in cooperation with tire-stacking device 210 and is incapable of connecting to tire-transporting device 230. Hook assembly 260 includes a framework 261 upon which an electronic worm gear 264 is mounted. Electronic worm gear 264 is connected to a pin 263, that may be retracted and advanced in order to open and close access to cavity 267, which is analagous to cavity 257 described with respect to hook assembly 250. Power is delivered to electronic worm gear 264 via a power cord 265 that is retracted and paid out from reel 268 that in turn is mounted on the fender of lift truck 22*b*. Reel 268 automatically takes up any slack in power cord 265. As the lifting apparatus 22 of the lift truck 22*b* is raised and lowered, power cord 265 is retracted and paid out of reel 268 as needed. Power is delivered to power cord 265 from onboard power supplied by the lift truck. A switch (not shown) is mounted in the cab of the lift truck and allows the operator to raise and lower pin 263 to open and close access to cavity 267.

When using tire-stacking device 210, it is sometimes difficult to back away from a stack of tires without having the base end 212 (FIG. 10) swing away from the lift truck. In order to alleviate this problem and otherwise prevent the tire-stacking device from swinging away from the lift truck when in its upright position as shown in FIG. 22, three different latching mechanism components have been devised. The first component is described in relationship to FIGS. 19 and 20, the second component is illustrated and described with reference to FIGS. 10 and 21, and the third is described in relation to FIGS. 23–25.

Figure 19:
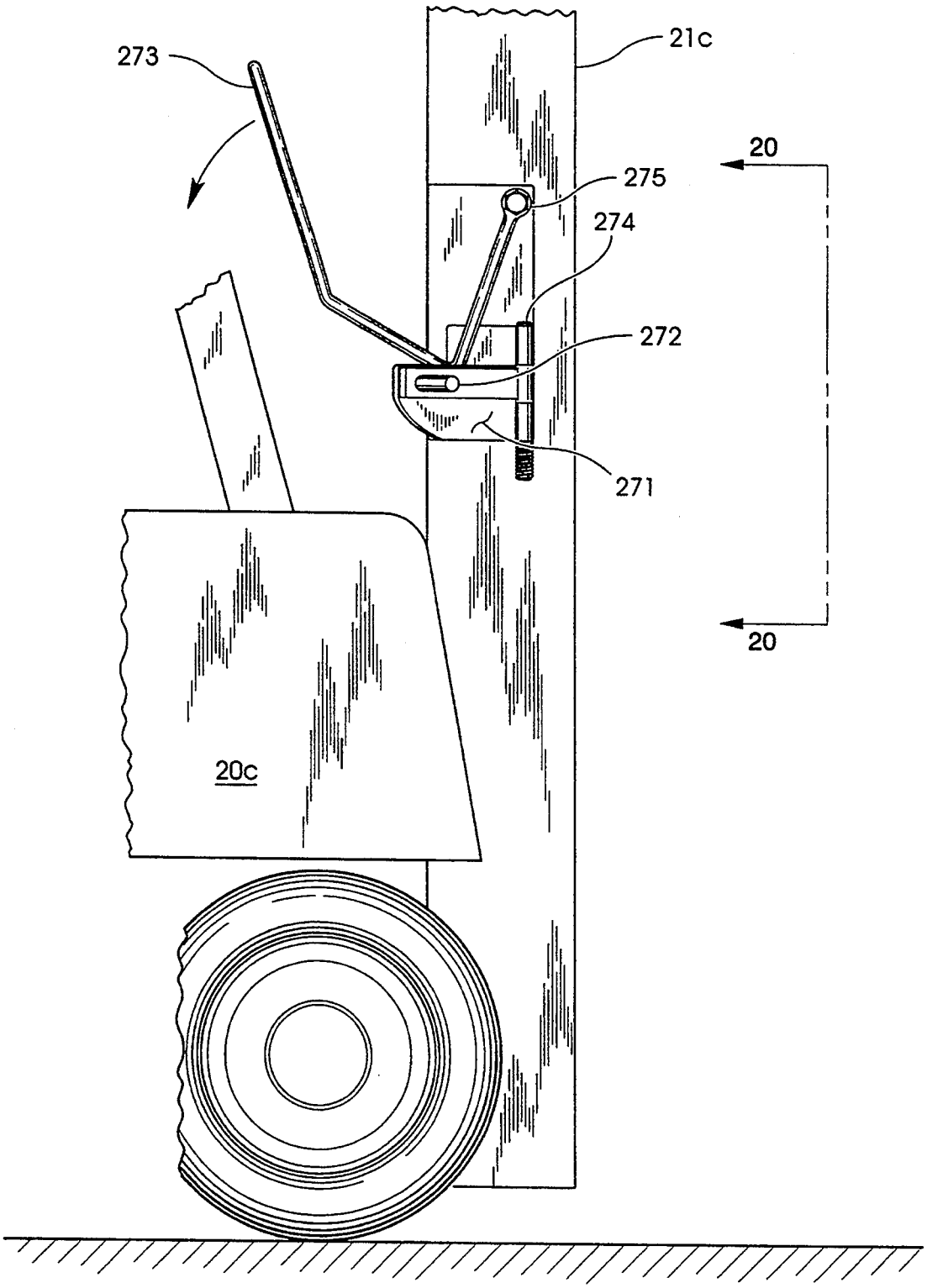
FIG. 19 is a partial side elevational view of a lift truck having a component assembly attached thereto for preventing a tire-stacking device from swinging away from the lift truck according to still another aspect of the present invention.
Figure 20:
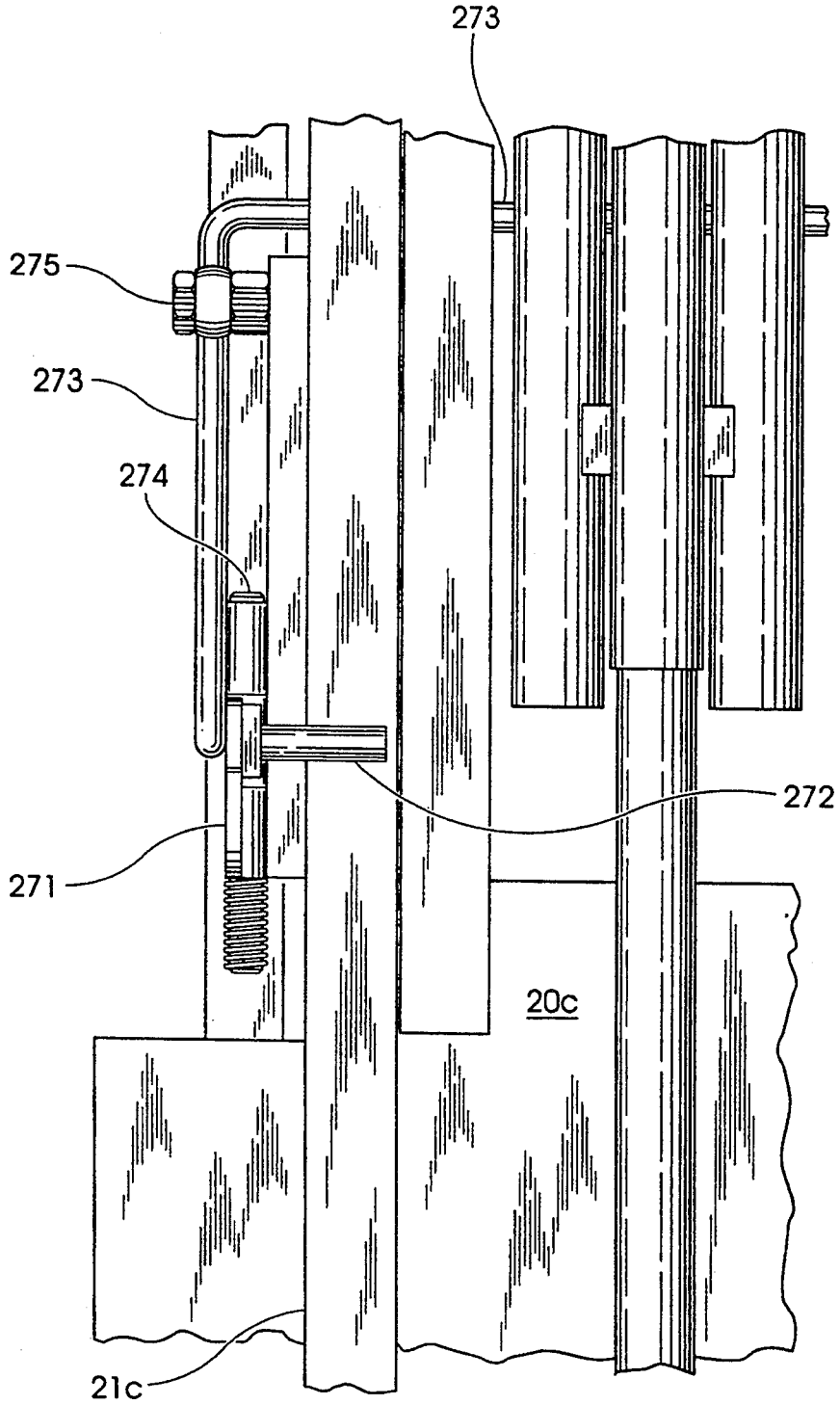
FIG. 20 is a partial front elevational view of the lift truck in FIG. 19 looking in the direction of arrows 20—20 after the component assembly has been moved to its locked position.

FIGS. 19 and 20 show the first latching component attached to the mast 21*c* of a lift truck 20*c*. The first component includes a push/pull bar 273 that is pivotably mounted to mast 21*c* on mounting bolts 275. A wing 271 is pivotably mounted on a hinge 274 below mounting bolt 275. Hinge 274 is spring-biased to normally maintain wing 271 in its retracted position as shown in FIG. 19. However, when push/pull bar 273 is rotated counterclockwise around mounting bolt 275, it forces wing 271 to swing around to its locked position as shown in FIG. 20. In the locked position, pin 272, which is attached to wing 271, traps a portion of the frame of the tire-stacking device against mast 21*c* of the lift truck 20*c*. This configuration is better illustrated in FIG. 22 where pin 272 has trapped a portion of frame 211 against the outer face of mast 21*e*. Although not shown, a pair of wings are preferably mounted on each side of the mast 21*e*. In this way, the pair of wings prevent the tire-stacking device from swinging laterally and the pins 272 prevent the tire-stacking device from swinging away from the lift truck when moving or depositing a stack of tires.

Figure 21:
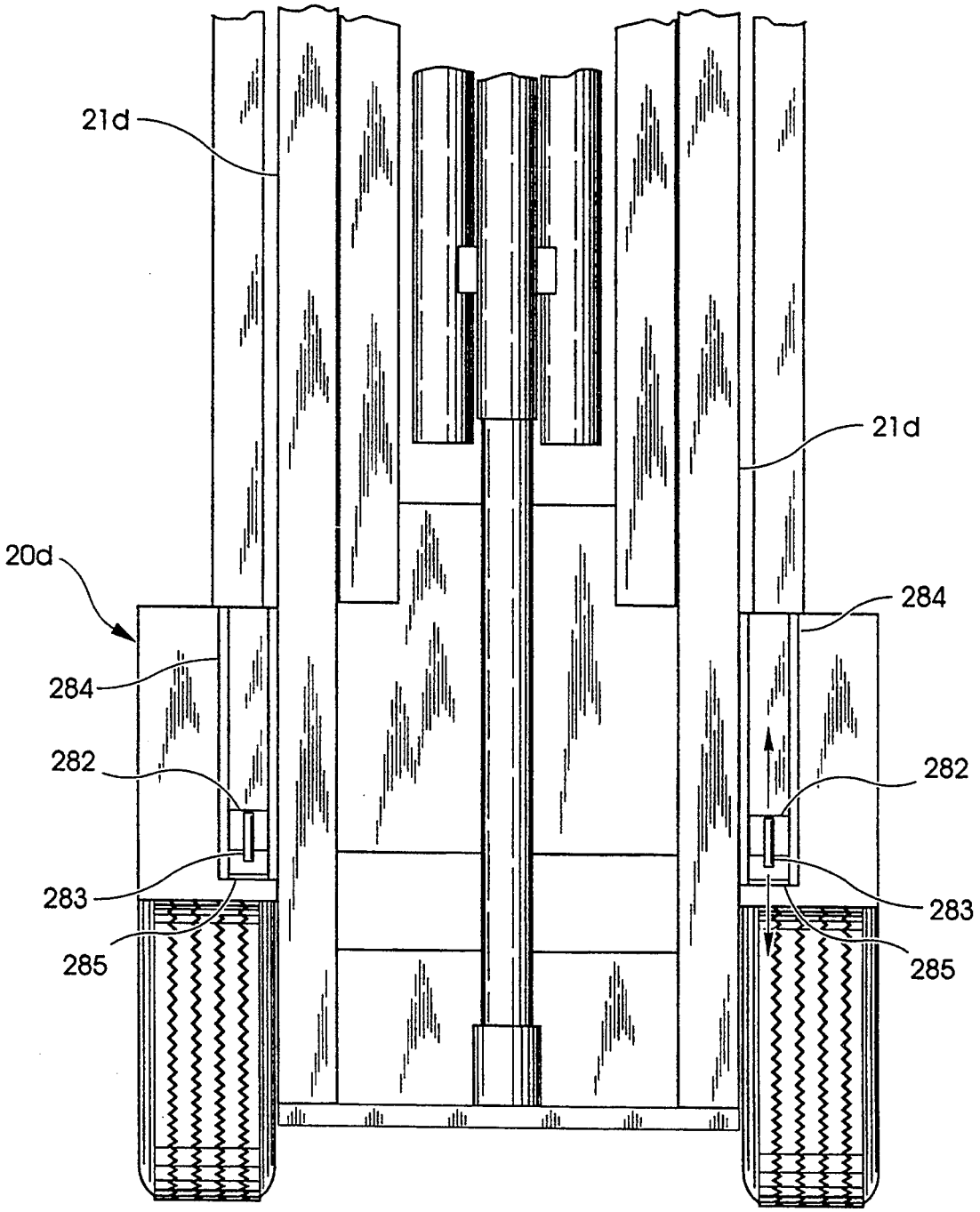
FIG. 21 is a front elevational view of a lift truck having an alternative component assembly for preventing the tire-stacking device from swinging with respect to the lift truck.
Figure 22:
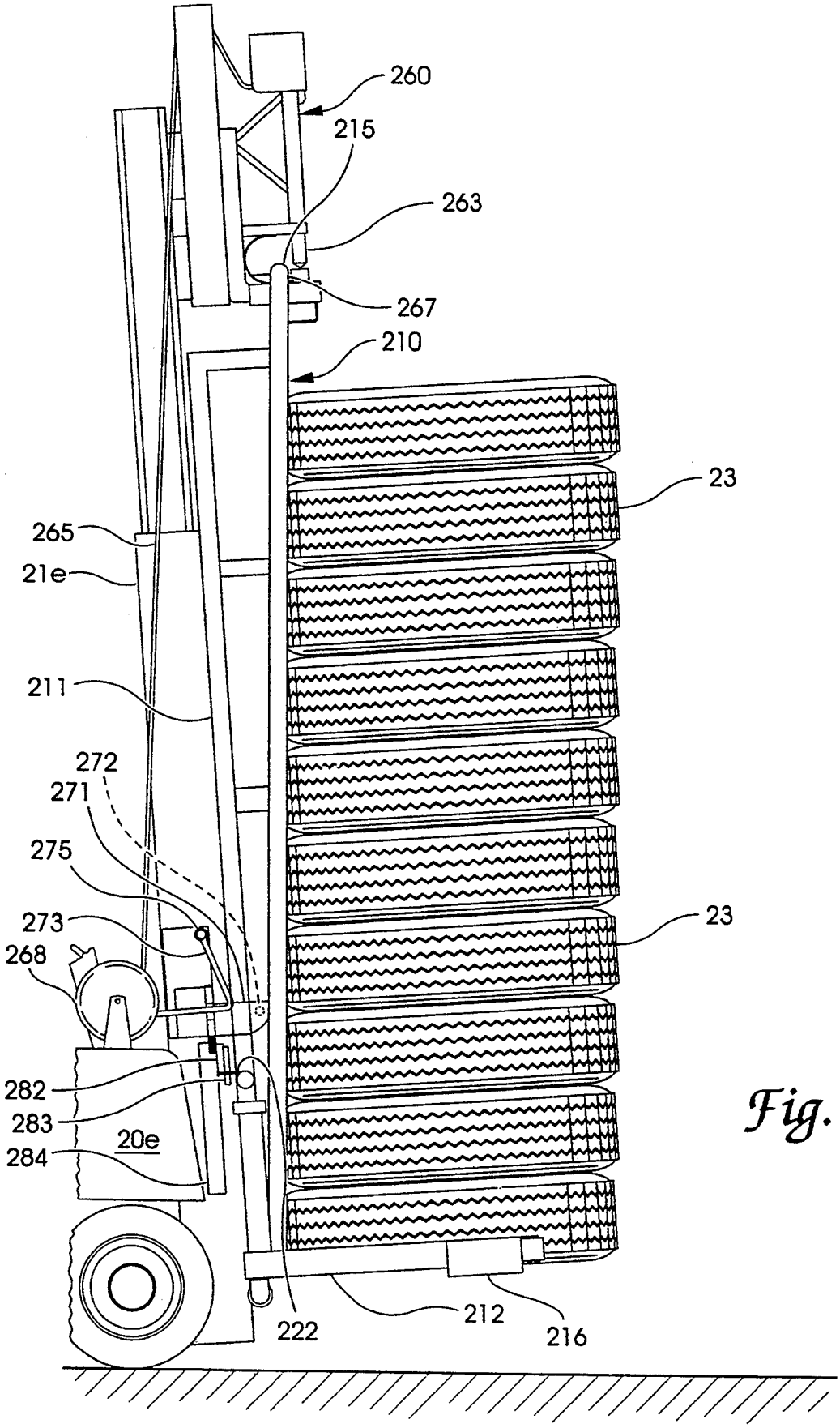
FIG. 22 is a partial side elevational view of a lift truck supporting a stack of tires with a tire-stacking device according to the present invention.

FIG. 21 illustrates a second and different component for preventing the base of the tire-stacking device from swinging with respect to the lift truck. In this alternative aspect of the invention, a pair of channels 284 are mounted on either side of the mast 21*d* of a lift-truck 20*d*. A metal block 285 is welded to the bottom of channels 284 in order to prevent sliders 282 from escaping through the bottom of the channels. Sliders 282 are otherwise free to slide up and down within channels 284. Each slider has a pin 283 welded thereto as shown in FIG. 21. When tire-stacking device 210 is lifted off the ground while in its vertical position (FIG. 22), bores 223 of latch members 222 (FIG. 10), receive pins 283 as shown in FIG. 22. Thus, the force of gravity maintains the pins within bores 223 of latches 222 when the tire-stacking device is raised and lowered because sliders 282 are able to slide up and down within channels 284. However, blocks 285 are positioned such that latches 222 only engage pins 283 when the tire-stacking device is in its vertical position. In other words, pins 283 remain engaged to latches 222 when the tire-stacking device is lowered in a vertical position into contact with the ground. This allows the operator to back away from a stack of tires without the base of the tire-stacking device swinging away from the lift truck.

The operator can disengage the latches by lowering the tire-stacking device in its vertical position into contact with the ground and then tilting the top of the mast backwards toward the lift truck sufficiently that latches 222 just become disengaged from pins 283. In other words, the tilting of the mast of the lift truck slightly raises pins 283 with respect to latches 222 when the tire-stacking device is in contact with the ground. This means that the operator should have the mast tilted backwards when raising the tire-stacking device from its horizontal position to its vertical position as illustrated in FIGS. 1–3. After the tire-stacking device has been raised to its vertical position, the operator pivots the mast forwardly returning it to its vertical position so that pins 283 just enter bores 223 of latches 222 to hold the base of the tire-stacking device from swinging with respect to the lift truck, even though the tire-stacking device is still in contact with the ground. Although a lift truck would ordinarily be equipped with only one type of swing inhibiting component, FIG. 22 shows both of the previously described components in their latched position holding the base 212 of tire-stacking device 210 against the front face of mast 21*e*.

It is important that latches 222 be adjustable to accommodate the particular frontal structure of different lift trucks. Also, it is important to note that latches 222 are mounted upon hinges 228 which enable them to pivot out of the way when the tire-stacking device 210 is lowered into its horizontal position. In other words, latches 222 pivot so that the device is supported by frame 211 instead of the ends of the latches. Hinges 228 are in turn securely attached to mounting plates 229 which include a plurality of mounting bores which provide vertical adjustability. Mounting plates 229 are each secured to one wing of L-shaped adjustment plates 227 which are adjustable laterally on an inverted U-shaped bracket 226. In turn, inverted U-shaped bracket 226 can be slid along frame 211 and mounted at any appropriate location above clamping arrangement 218. Adjustable mounting plates 229, plates 227 and bracket 226 allow latches 222 to be positioned to accommodate the size and structure of most lift trucks. These various brackets are better illustrated in FIG. 23, which shows the third type of anti-swing component.

Figure 23:
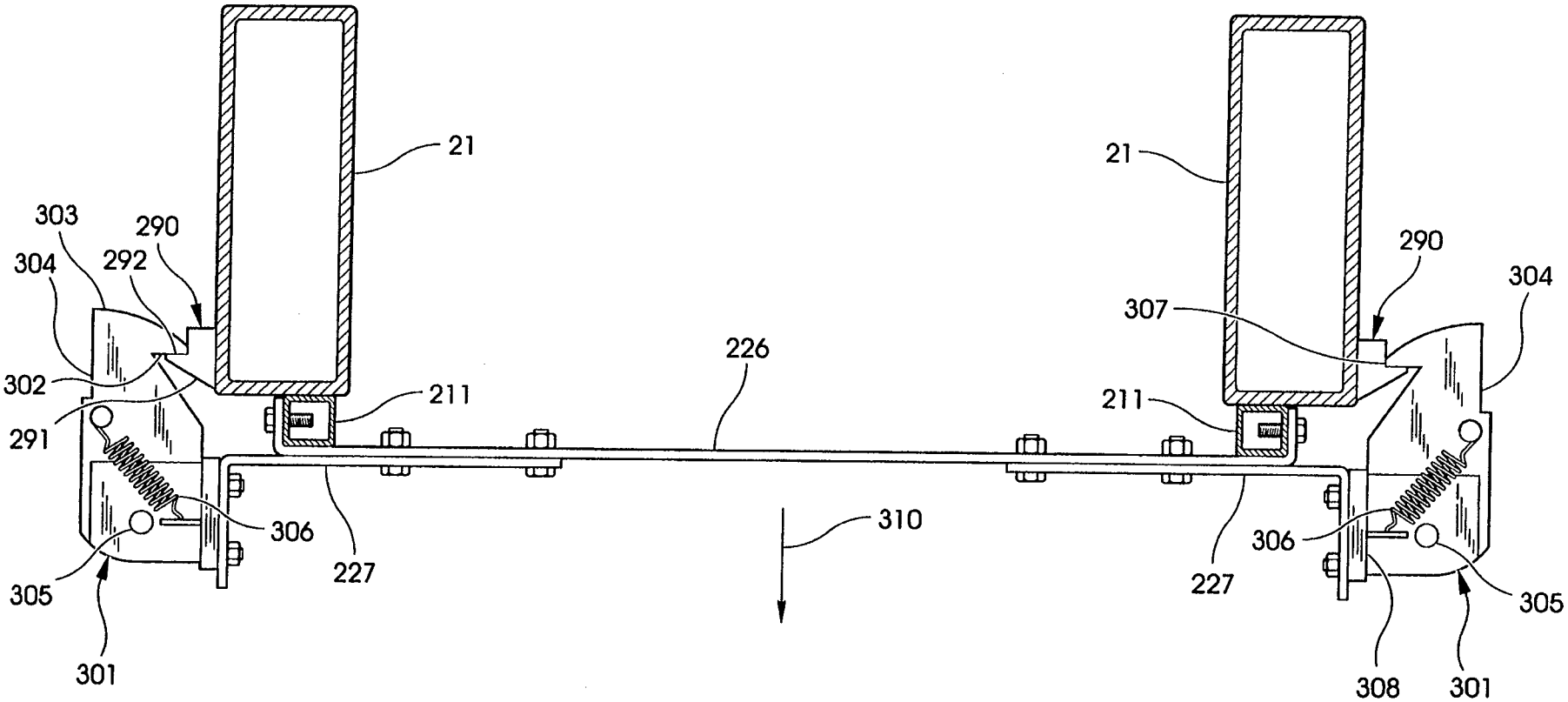
FIG. 23 is a partial sectioned top view of still another alternative component assembly for preventing the tire-stacking device from swinging with respect to the lift truck.

For clarity in illustrating the structure and function of the third component for preventing the base of the tire-stacking device from swinging with respect to the lift truck, FIG. 23 only shows a cross-section of mast 21 for a lift truck. In this alternative, elongated catch pieces 290 are mounted to the sides of mast 21 in place of the channel and slider configuration shown in FIG. 21. In place of latches 222 of the earlier version, a pair of catch hook assemblies 301 are mounted on either side of L-shaped brackets 227. L-shaped brackets are in turn adjustably mounted on inverted U-shaped bracket 226, which is itself attached along the base rail of frame 211 of the tire-stacking device 210 (FIG. 10). The adjustability of the various mounting brackets permits the catch hook assemblies 301 to be attached to the tire-stacking device in a way which can accommodate the mast structure of virtually any lift truck in the same manner as latches 222 just discussed. When properly mounted and adjusted, hook edge 302 of catch assembly 301 rests against catch surface 292 of catch piece 290 to prevent the tire-stacking device (only partially shown) from swinging away from the lift truck along arrow 310. When the tire-stacking device is lifted from its horizontal position to its vertical position as illustrated in FIGS. 1–3, curved edge 303 of catch plate 304 scrapes against lateral ramp surface 291 causing catch plate 304 to pivot around pin 305 against the action of tension spring 306. When the frame 211 finally comes in contact with the mast 21 of the lift truck, catch plate 304 locks in place against catch piece 290 as shown in FIG. 23.

Figure 24:
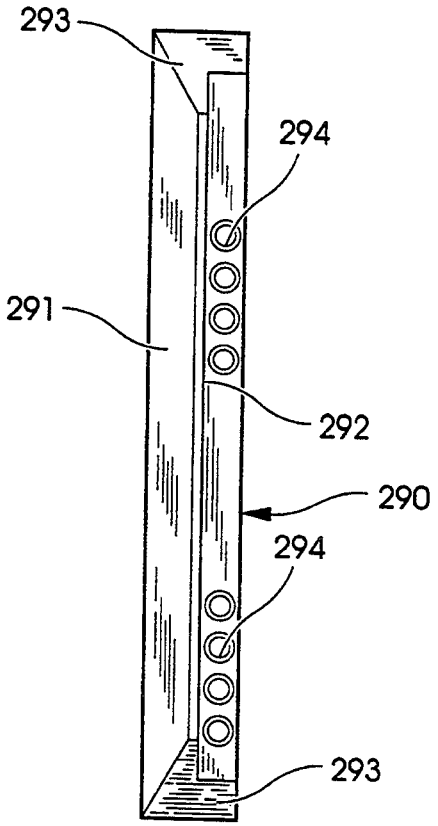
FIG. 24 is a side elevational view of a catch piece for use in the component assembly shown in FIG. 23.

When the tire-stacking device is lifted off the ground in its vertical position, hook edge 302 slides along the length of catch surface 292 (FIG. 24). It is important that catch piece 290 be attached to mast 21 of the lift truck a proper distance above the ground so that the lift truck operator is able to disengage catch hook assembly 301 from catch piece 290 when the tire-stacking device is lowered in its vertical position into contact with the ground and the mast 21 of the lift truck is tilted backwards. Typically, tilting mast 21 can cause relative movement between hook edge 302 and catch surface 292 on the order of $\frac{3}{4}$ to 1-$\frac{1}{2}$ inches. Thus, catch piece 290 should be mounted such that end edge 307 of catch plate 304 slides below catch surface 292 onto or below end ramp 293 when the mast is tilted backward. In this way, the slight relative movement caused by tilting the mast is sufficient to disengage hook edge 302 from catch surface 292, thus enabling the lift truck operator to lower the tire-stacking device from its vertical position to a horizontal position. This disengagement in turn allows the operator to completely disengage the lift truck from the tire-stacking device 210 as shown in FIG. 13. Hook edge 302 automatically slides up end ramp 293 into contact with catch surface 292 when the tire-stacking device is lifted off the ground. Likewise, hook edge 302 automatically rehooks itself with catch surface 292 when the tire-stacking device is lowered from a position above catch piece 290.

Figure 25:
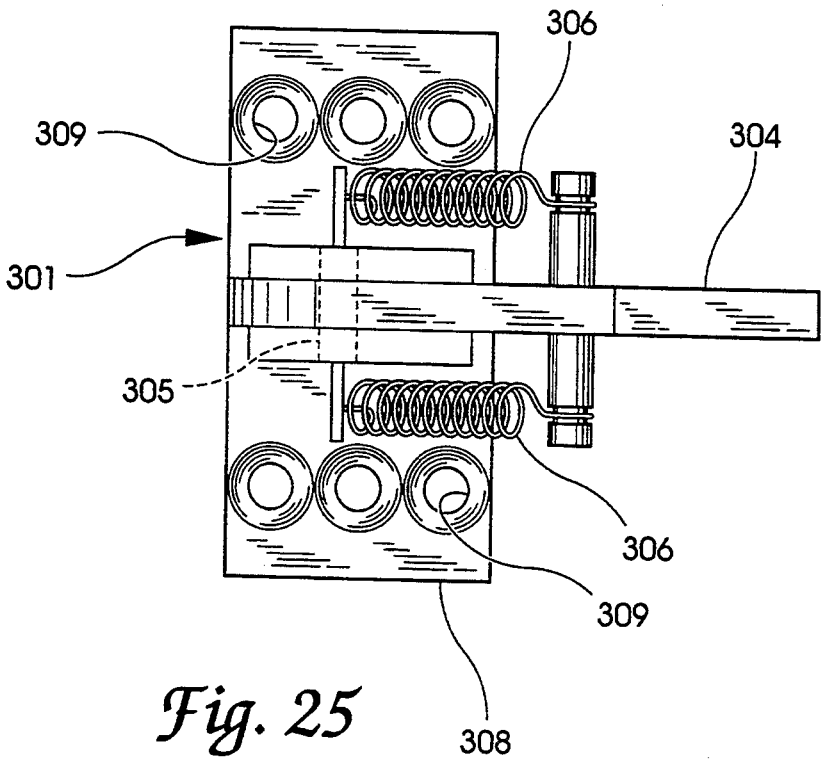
FIG. 25 is a side elevational view of a catch hook for use in the component assembly of FIG. 23.

Referring to FIG. 25, catch hook assembly 301 is secured to one side of a mounting plate 308 having a plurality of mounting bores 309 similar to the mounting plate 229 of latches 222 discussed earlier. The plurality of mounting bores 309 allow the catch hook assembly 301 to be adjustably mounted to the L-shaped brackets 227 to accommodate the particular structure of the tire-stacking device and lift truck. Catch plate 304 is pivotally mounted between a pair of upstanding side walls on pivot pin 305. Tension springs 306, which are mounted on either side of catch plate 304, normally maintain the catch plate in the position shown in FIG. 23. However, when the tire-stacking device is in a horizontal position as shown in FIG. 10, the pivoting feature of catch hook assemblies 301 allows the pivot plates to pivot off to the side so that the weight of the tire-stacking device is supported by frame 211 rather than the curved edges 303 of the catch plates. This pivoting feature of catch hook assemblies 301 also facilitates the automatic latching of hook edge 302 with catch surface 292 as discussed previously. It should be pointed out that catch piece 290 is provided with a plurality of mounting bores 294 so that the catch piece can be remounted and calibrated as tire wear on the lift truck changes the functional relationship between catch piece 290 and catch hook assemblies 301. Any mounting bores 294 that are not in use, are normally plugged so that end edge 307 of catch plate 304 does not become snagged when the tire-stacking device is raised and lowered with respect to the ground when in its vertical position.

Figure 26:
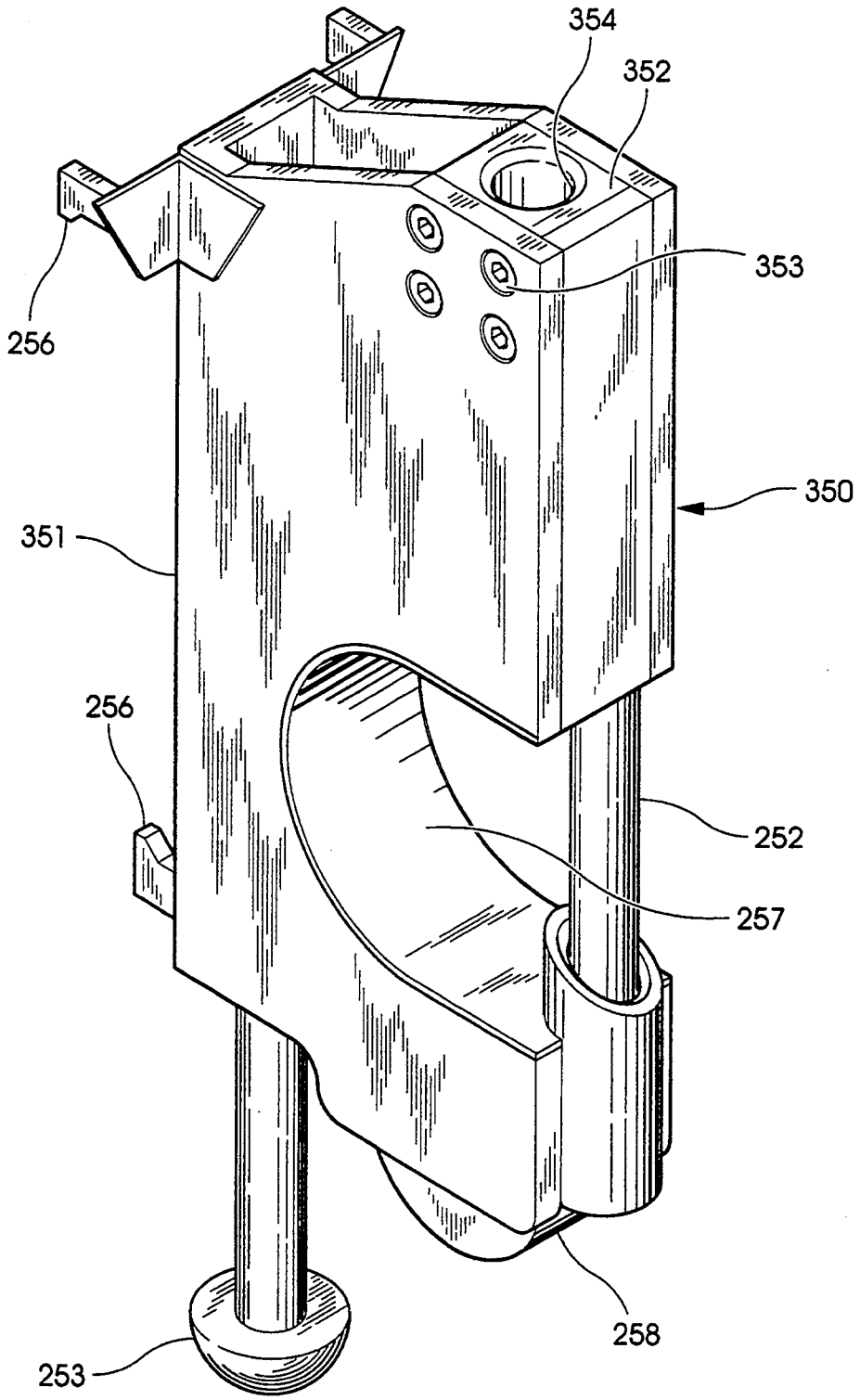
FIG. 26 is an isometric view of an alternative hooking assembly according to one aspect of the present invention.
Figure 27:
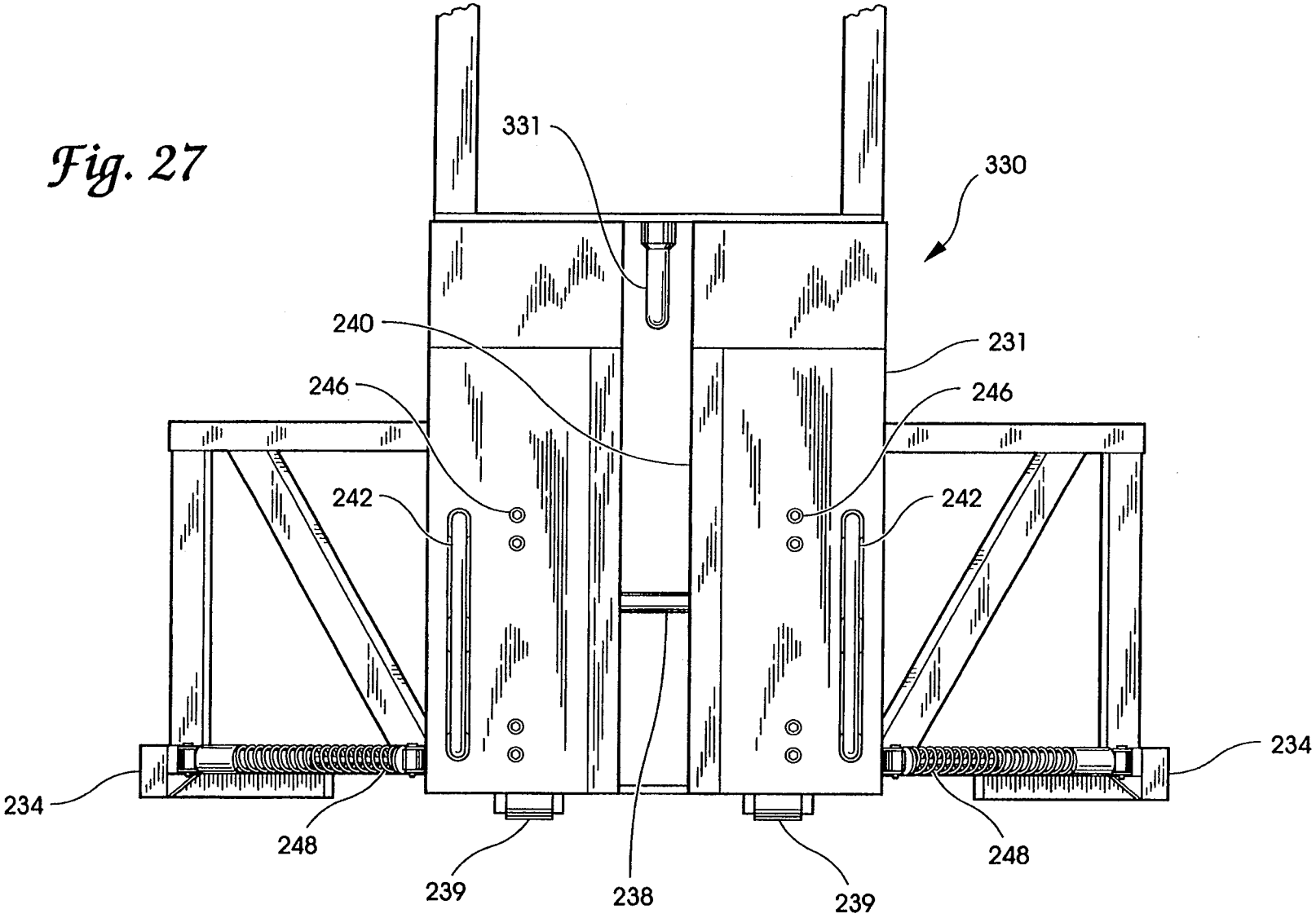
FIG. 27 is a rear elevational view of a tire transporter according to another embodiment of the present invention.

Referring now to FIGS. 26 and 27, a modified hook assembly 350 is illustrated for use in conjunction with an alternative embodiment of tire transporter 330. Hook assembly 350 is similar to hook assembly 250 described earlier in relationship to FIG. 17, and like numbers are used to identify identical features. However, in place of hook 254 of hook assembly 250, hook assembly 350 includes a slightly modified housing 351 that includes a block 352 mounted therein via screws 353. The block includes a vertical bore 354 that receives vertical lifting pin 331 of the alternative embodiment of tire transporter 330. Hook assembly 350 is used in a manner similar to that of hook assembly 250 discussed in reference to FIGS. 13–16; however, instead of lifting pin 237 of tire transporter 230 being received in hook 254, vertical lifting pin 331 is received in vertical bore 354 of hook assembly 350.

This difference allows tire transporter 330 to pivot slightly about the vertical axis defined by vertical pin 331 because channel 240 is slightly wider than hook assembly 350. This subtle feature results in a tire transporter 330 that is much more forgiving to the lift truck operator when approaching a stack of tires to be lifted.

In particular, in the tire transporter 230 discussed earlier, the lift truck operator must approach a stack of tires nearly dead center in order to get the clamping mechanism 218 properly actuated and positioned about the base tire of the stack. The vertical pin structure of tire transporter 330, on the other hand, allows the tire transporter to pivot slightly about the pin when approaching a stack of tires so that the tire transporter automatically compensates when the lift truck operator approaches the stack of tires slightly off center. When tire transporters 330 does pivot with respect to the lift truck, one of the spring-loaded upright bars 242 is depressed against the front face of the lift truck. The spring action of upright bars 242 causes the tire transporter 330 to reassume its position straight in front of the lift truck when the stack of tires is lifted off of the ground. Thus, the lift truck operator can approach a stack of tires slightly off center causing the transporter to pivot to one side or the other, but the return spring action of upright bars 242 (see FIG. 12) causes the tire transporter 330 to reassume a straight-ahead position on the lift truck once the tires are lifted above the ground.

While the invention has been illustrated and described in detail in the drawings and foregoing description, the same is to be considered as illustrative and not restrictive in character. It is to be understood that only the preferred embodiment has been shown and described and that all changes and modifications that come within the spirit of the invention are desired to be protected.

What is claimed is:

1. A tire-stacking device for use in cooperative arrangement with a lift truck having a lifting apparatus, the tire-stacking device comprising:

a frame having a base end, a lifting end and a platform extending between said ends, said platform being capable of supporting a plurality of tires in side-by-side relation when said frame is in a horizontal position;

a lateral support structure having a root end, a free end and a support surface positioned between said ends, said root end being attached to said base end of said frame with said free end of said lateral support structure extending away from said platform, said support surface being capable of supporting the plurality of tires when said frame is in a vertical position;

roller means, attached to said base end, for supporting said base end of said frame;

means for releasably connecting said lifting end of said frame to the lifting apparatus of the lift truck; and means for preventing said base end of said frame from swinging away from the lift truck when said frame is in said vertical position and the lift truck is depositing said plurality of tires.

2. The tire-stacking device of claim 1 wherein said lateral support structure includes a pair of gripping arms having a root end pivotably attached to said base end of said frame, each of said arms has a free end with a support surface extending inwardly toward the other arm, and said arms are capable of pivoting toward and away from each other.

3. The tire-stacking device of claim 1 wherein said connecting means includes a hook attached to the lifting apparatus of the lift truck; and said lifting end of said frame has a lifting element that is hookable to said hook.

4. The tire-stacking device of claim 3 wherein said hook includes a sliding pin having an open position and a closed position; and wherein said lifting element is trapped within said hook when said sliding pin is in said closed position, and said lifting element can enter said hook when said sliding pin is in said open position.

5. The tire-stacking device of claim 4 wherein said sliding pin is moved between said open position and said closed position by an electronic worm gear operably connected to said sliding pin.

6. The tire-stacking device of claim 1 wherein said frame includes a pair of roller rails that permit a stack of tires to settle when the tire-stacking device is lifted to said vertical position.

7. The tire-stacking device of claim 1 wherein said preventing means is at least one lock pin movably attached to the lift truck and movable between a release position and a locked position wherein a portion of said frame is trapped between said at least one lock pin and the lift truck.

8. The tire-stacking device of claim 1 wherein said preventing means is at least one latch attached to one of either said frame or the lift truck, and the other of said frame or the lift truck includes at least one pin receivable in said at least one latch when the the tire-stacking device is in said vertical position.

9. The tire-stacking device of claim 1 wherein said preventing means is at least one catch piece attached to the lift truck, and said frame includes at least one hook assembly that hooks to said catch piece when the tire-stacking device is lifted to said vertical position.

10. A tire-stacking device for use in cooperative arrangement with a lift truck having a lifting apparatus, the tire-stacking device comprising:

a frame having a base end, a lifting end and a platform extending between said ends, said platform being capable of supporting a plurality of tires in side-by-side relation when said frame is in a horizontal position;

a lateral support structure having a root end, a free end and a support surface positioned between said ends, said root end being attached to said base end of said frame with said free end of said lateral support structure extending away from said platform, said support surface being capable of supporting the plurality of tires when said frame is in a vertical position, said support structure including a pair of gripping arms biased toward each other, said gripping arms having a root end pivotably attached to said base end of said frame, each of said arms having a free end with a support surface extending inwardly toward the other arm, said arms being capable of pivoting toward and away from each other, and said free end of each of said arms having a roller mounted thereon for riding against a tire to spread said arms apart;

roller means, attached to said base end, for supporting said base end of said frame;

means for releasably connecting said lifting end of said frame to the lifting apparatus of the lift truck; and means for preventing said base end of said frame from swinging away from the lift truck when said frame is in said vertical position.

11. A tire-stacking device for use in cooperative arrangement with a lift truck having a lifting apparatus, the tire-stacking device comprising:

a frame having a base end, a lifting end and a platform extending between said ends, said platform being capable of supporting a plurality of tires in side-by-side relation when said frame is in a horizontal position;

a lateral support structure having a root end, a free end and a support surface positioned between said ends, said root end being attached to said base end of said frame with said free end of said lateral support structure extending away from said platform, said support surface being capable of supporting the plurality of tires when said frame is in a vertical position;

roller means, attached to said base end, for supporting said base end of said frame;

a hook attached to the lifting apparatus of the lift truck;

a lifting element attached to said lifting end of said frame and being hookable to said hook, said lifting element including an arcuate shaped lifting bar centered at said lifting end of said frame and having means for adjusting the height of said lifting bar above the ground; and means for preventing said base end of said frame from swinging away from the lift truck when said frame is in said vertical position.

12. A tire-stacking device for use in cooperative arrangement with a lift truck having a lifting apparatus, the tire-stacking device comprising:

a frame having a base end, a lifting end and a platform extending between said ends, said platform being capable of supporting a plurality of tires in side-by-side relation when said frame is in a horizontal position;

a lateral support structure having a root end, a free end and a support surface positioned between said ends, said root end being attached to said base end of said frame with said free end of said lateral support structure extending away from said platform, said support surface being capable of supporting the plurality of tires when said frame is in a vertical position;

roller means, attached to said base end, for supporting said base end of said frame;

a hook attached to the lifting apparatus of the lift truck, said hook including a sliding pin having an open position and a closed position, said hook being configured so that said sliding pin automatically falls to said closed position under the action of gravity, said sliding pin including a push nob that extends below said hook such that moving said push nob toward said hook moves said sliding pin toward said open position, said push nob being pushed toward said hook when the lifting apparatus of the lift truck is lowered to a position adjacent the ground;

a lifting element attached to said lifting end of said frame and being hookable to said hook, said lifting element being trapped within said hook when said sliding pin is in said closed position, and said lifting element can enter said hook when said sliding pin is in said position; and means for preventing said base end of said frame from swinging away from the lift truck when said frame is in said vertical position.

13. A tire-stacking device for use in cooperative arrangement with a lift truck having a lifting apparatus, the tire-stacking device comprising:

a frame having a base end, a lifting end and a platform extending between said ends, said platform being capable of supporting a plurality of tires in side-by-side relation when said frame is in a horizontal position;

a lateral support structure having a root end, a free end and a support surface positioned between said ends, said root end being attached to said base end of said frame with said free end of said lateral support structure extending away from said platform, said support surface being capable of supporting the plurality of tires when said frame is in a vertical position;

roller means, attached to said base end, for supporting said base end of said frame;

means for releasably connecting said lifting end of said frame to the lifting apparatus of the lift truck; and means for preventing said base end of said frame from swinging away from the lift truck when said frame is in said vertical position, said preventing means including two lock pins, each of said lock pins being mounted on a wing pivotally attached to the lifting truck, said lock pins being pivotable between a release position and a locked position wherein a portion of said frame is trapped between each of said lock pins and the lift truck.

14. A tire-stacking device for use in cooperative arrangement with a lift truck having a lifting apparatus, the tire-stacking device comprising:

a frame having a base end, a lifting end and a platform extending between said ends, said platform being capable of supporting a plurality of tires in side-by-side relation when said frame is in a horizontal position;

a lateral support structure having a root end, a free end and a support surface positioned between said ends, said root end being attached to said base end of said frame with said free end of said lateral support structure extending away from said platform, said support surface being capable of supporting the plurality of tires when said frame is in a vertical position;

roller means, attached to said base end, for supporting said base end of said frame;

means for releasably connecting said lifting end of said frame to the lifting apparatus of the lift truck; and means for preventing said base end of said frame from swinging away from the lift truck when said frame is in said vertical position, said preventing means including two latches attached to said frame and two pins connected to the lift truck, each of said pins being slidably mounted in a vertically oriented channel attached to the lift truck, wherein said pins are received within said latches when the tire stacking device is in said vertical position.

15. A tire transporter for use in cooperative arrangement with a lift truck having a lifting apparatus, the transporter comprising:

a vertical frame having a length and a base end;

a horizontal support structure including a pair of gripping arms having root ends pivotably attached to said base end of said frame, each of said arms having a free end extending away from said frame and a support surface extending inwardly toward the other arm, and said arms are capable of pivoting toward and away from each other, said support surfaces being capable of supporting a stack of tires, each of said arms being biased toward each other, and said free end of each of said arms having a roller mounted thereon for riding against a tire to spread said arms apart; and means for releasably connecting said frame to the lifting apparatus of the lift truck.

16. The tire transporter of claim 15 wherein said connecting means includes a hook means having a hook attached to the lifting apparatus of the lift truck; and said frame includes a lifting element that is hookable to said hook.

17. The tire transporter of claim 16 wherein said hook means includes means for permitting the tire transporter to pivot about a vertical axis with respect to said lifting element.

18. A tire transporter for use in cooperative arrangement with a lift truck having a lifting apparatus, the transporter comprising:

a vertical frame having a length and a base end;

a horizontal support structure including a pair of gripping arms having root ends pivotably attached to said base end of said frame, each of said arms having a free end extending away from said frame and a support surface extending inwardly toward the other arm, and said arms are capable of pivoting toward and away from each other, said support surfaces being capable of supporting a stack of tires; and a hook means for releasably connecting said frame to the lifting apparatus of the lift truck, said hook means including a hook attached to the lifting apparatus of the lift truck, and a sliding pin having an open position and a closed position; and a lifting element attached to said frame, said lifting element being hookable to said hook, wherein said lifting element is trapped within said hook when said sliding pin is in said closed position, and said lifting element can enter said hook when said sliding pin is in said open position.

19. The tire transporter of claim 18 wherein said hook means is arranged so that said sliding pin automatically falls to said closed position under the action of gravity;

said sliding pin includes a push nob that extends below said hook means such that moving said push nob toward said hook means moves said sliding pin toward said open position; and said push nob is pushed toward said hook means when the lifting apparatus of the lift truck is lowered to a position adjacent the ground.

20. The tire transporter of claim 19 wherein said length is shorter than the height of the lift truck.

* * * * *

UNITED STATES PATENT AND TRADEMARK OFFICE

CERTIFICATE OF CORRECTION

PATENT NO. : 5,385,440

DATED : January 31, 1995

INVENTOR(S) : Thomas M. Raben

It is certified that error appears in the above-identified patent and that said Letters Patent is hereby corrected as shown below:

On title page, item [57], at line 14 thereof, replace "kite" with --tire--.

Signed and Sealed this

Twenty-ninth Day of August, 1995

Bruce Lehman

*Attest:*

BRUCE LEHMAN

*Attesting Officer*

*Commissioner of Patents and Trademarks*